US007683297B2

(12) United States Patent
Kishi et al.

(10) Patent No.: US 7,683,297 B2
(45) Date of Patent: Mar. 23, 2010

(54) ELECTRIC POWER SUPPLY CONTROL DEVICE, HEATING DEVICE AND FIXING DEVICE

(75) Inventors: Kazuhito Kishi, Kanagawa (JP); Masami Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 166 days.

(21) Appl. No.: 11/405,448

(22) Filed: Apr. 18, 2006

(65) Prior Publication Data

US 2006/0237446 A1 Oct. 26, 2006

(30) Foreign Application Priority Data

Apr. 22, 2005 (JP) ..... 2005-125790
Jul. 20, 2005 (JP) ..... 2005-210451

(51) Int. Cl.
*H05B 6/14* (2006.01)
*G03G 15/20* (2006.01)
*G03G 15/00* (2006.01)

(52) U.S. Cl. ..... 219/619; 399/88; 399/70; 399/69

(58) Field of Classification Search ..... 219/619, 219/216, 660, 483, 486; 399/69, 67, 70, 399/88, 33, 328–334
See application file for complete search history.

(56) References Cited

U.S. PATENT DOCUMENTS 5,854,465 A 12/1998 Kishi et al.
6,144,832 A 11/2000 Nimura et al.
6,542,705 B2 4/2003 Fujita et al.
7,002,112 B2 2/2006 Kishi et al.
7,010,255 B2 3/2006 Yura et al.
2004/0245235 A1 12/2004 Kishi et al.
2004/0245241 A1 12/2004 Kishi et al.

(Continued)

FOREIGN PATENT DOCUMENTS

JP 2000-315567 11/2000

(Continued)

OTHER PUBLICATIONS

U.S. Appl. No. 11/582,991, filed Oct. 19, 2006, Kishi, et al.

(Continued)

*Primary Examiner*—Quang T Van
(74) *Attorney, Agent, or Firm*—Oblon, Spivak, McClelland, Maier & Neustadt, L.L.P.

(57) ABSTRACT

An electric power supply part supplies electric power to a heat-generating member and a power requiring part. A control part controls electric power supplied to the heat-generating member and the power requiring part. A first mode is to supply electric power to the heat-generating member from only a main electric power supply device and to the power requiring part from both the main electric power supply device and an auxiliary electric power requiring part. A second mode is to supply electric power to the heat-generating member and the power requiring part from only the main electric power supply device and causing electric power supplied to the heat-generating member to be smaller than a rated electric power of the heat-generating member. The electric power supplied to the heat-generating member in the first mode is caused to be larger than the electric power supplied to the heat-generating member in the second mode.

13 Claims, 18 Drawing Sheets

U.S. PATENT DOCUMENTS

| | | | |
|---|---|---|---|
| 2004/0247332 | A1 | 12/2004 | Kishi et al. |
| 2004/0247334 | A1 | 12/2004 | Kishi et al. |
| 2004/0258426 | A1 | 12/2004 | Kishi et al. |
| 2005/0123315 | A1 | 6/2005 | Kishi et al. |
| 2005/0139584 | A1 | 6/2005 | Kishi et al. |
| 2005/0175368 | A1 | 8/2005 | Matsusaka et al. |
| 2005/0175370 | A1 | 8/2005 | Matsusaka et al. |
| 2005/0191078 | A1 | 9/2005 | Kishi et al. |
| 2006/0039713 | A1 | 2/2006 | Kishi et al. |
| 2006/0051111 | A1 | 3/2006 | Kishi et al. |
| 2006/0051112 | A1 | 3/2006 | Matsusaka et al. |
| 2006/0051113 | A1 | 3/2006 | Kishi et al. |
| 2006/0051119 | A1 | 3/2006 | Kishi et al. |
| 2006/0051120 | A1 | 3/2006 | Kishi et al. |
| 2006/0051121 | A1 | 3/2006 | Matsusaka et al. |
| 2006/0237446 | A1 | 10/2006 | Kishi et al. |

FOREIGN PATENT DOCUMENTS

| | | |
|---|---|---|
| JP | 2002-14574 | 1/2002 |
| JP | 2002-44305 | 2/2002 |
| JP | 2003-140484 | 5/2003 |
| JP | 2005-216786 | 8/2005 |

OTHER PUBLICATIONS

U.S. Appl. No. 11/609,467, filed Dec. 12, 2006, Kishi et al.
U.S. Appl. No. 11/678,854, filed Feb. 26, 2007, Yano et al.

OPERATION STATE AND ELECTRIC POWER SUPPLY

SUPPLEMENT POWER SUPPLY WHEN FEEDING PAPER

SUPPLEMENTAL POWER SUPPLY AT STARTUP AND PAPER FEED

ELECTRIC POWER SUPPLY CONTROL DEVICE, HEATING DEVICE AND FIXING DEVICE

BACKGROUND OF THE INVENTION

1. Field of the Invention

The present invention generally relates to power supply control device and, more particularly, to a power supply control device for supplying an electric current to a heating element or a part requiring power supply and a heating device and a fixing device to which an electric current is supplied by the power supply control device.

2. Description of the Related Art

An image forming apparatus represented by a copy machine, a printer, a facsimile, a combination machine of the aforementioned or the like forms an image by image forming part and transfers the formed image onto a sheet-like recording material such as a recording paper or an OHP sheet. Various recording methods are materialized as an image recording method used in the image forming apparatus. From among those methods, an electrophotographic method is used widely by the above-mentioned apparatuses from viewpoints of high-speed, high image quality and low cost.

It is common to use a fixing device to fix an unfixed toner image transferred on a recording material by heat and pressure. A heat-roller method is used in many cases at present time as a fixing method in a fixing device from viewpoints of high-speed and safety. The heat-roller method is a method to heat a recording material, which is a material to be heated when viewing from a heating member, by passing through the recording material between the heating member such as a heating roller, which is heated by the heating member such as a halogen heater, and an opposing rotational member, which is arranged opposite to the heating member so as to form a mutual pressure-contacting part referred to as a pressure-contacting nip part by being brought into pressure-contact with the heating member. A metal roller, in which iron or aluminum is used as a metal core, is mainly used in the heating member, thereby increasing a heat capacity thereof. Thus, there is needed a long start-up time such as several minutes to ten and several minutes so as to raise a temperature to about 180° C., which is a temperature (fixing temperature) at which a toner is melted and usable.

Then, in the image forming apparatus, an electric power is supplied to a heat-generating member provided in the heating member also during a standby period in which a user of the apparatus does not perform printing, so as to maintain the temperature at a pre-heating temperature slightly lower than a usable temperature (fixing temperature). Thereby, the temperature of the heating roller is raised immediately to the usable temperature (fixing roller).

When an importance is given to the start-up of the temperature, a power which is not necessary for image formation, that is, a waste electric power, is consumed by the heat-generating member as a standby power during a period when the apparatus is not used. There is a result of investigation that indicates that energy consumed at the standby period occupies about 70 to 80 percent of energy consumed by an image forming apparatus.

In recent years, energy-saving regulation has been enacted due to the rise in environmental protection consciousness in each country. The Law concerning energy saving has been revised and strengthened in Japan, and an energy saving program such as the Energy Star or the ZESM (Zero Energy Star Mode) has been enacted also in the U.S. When attempting energy saving so as to respond to those regulations and programs, it is desired for image forming apparatuses to obtain a large energy saving effect in reducing energy consumption during a standby period to reduce a power supply to close to zero during the standby period.

When setting the power during the standby period of the apparatus to zero while the conventional structure of a fixing device is unchanged, a time is spent on rising of the temperature of the heat roller when restarting the device. Thus, the standby period is increased and use convenience is deteriorated. Accordingly, a structure of rapidly raising the heat roller is required in realizing energy saving in an image forming apparatus. For example, the above-mentioned ZESM requires an extremely severe condition such that a restart-up time from the standby state be less than 10 seconds.

In order to shorten the temperature rising time, it is possible to reduce the heat capacity of the heating member or to increase a supply power to the heating member (heat-generating member). With regard to making a low heat capacity, a startup with a short time such as 10 to 30 seconds in a middle and low print speed range such as about 50 cpm (50 sheets/1 minute) by reducing a thickness of a heat roller or a fixing roller as the heating means to several mm to 1 mm or using a film or a belt member as the heating member, thereby enabling reduction in the temperature rising time.

Although a supply voltage may be raised to increase a supply power to the heating means, a commercial power supply of 100V/15 A is general in a normal office in Japan, and 1500 W is an upper limit of the supply power. Thus, it is difficult to increase a supply power to the heating means by a general commercial power supply alone.

Although the low heat capacity of the heating means is effective in the middle and low print speed range, it is difficult to maintain the temperature of the heating means at a predetermined temperature is the heat capacity of the heating member is small since an amount of heat taken by a recording material from the heating means is larger than an amount of heat given to the heating means as a number of recording materials supplied per unit time is large in a high speed print range higher than 60 cpm (60 sheets/1 minute). In an image forming apparatus, such a decrease in the heating means may cause a fixation failure.

In order to solve the above-mentioned problem, there is suggested an image forming apparatus, which uses a power supply voltage of 200V to achieve a high speed range of a print speed. However, it is necessary to change a power supply source at an installation location, and, thus, it is not a general solution. Additionally, there is an apparatus put into practice that used two lines of 100V/15 A to increase a total supply power, but it is difficult to install the apparatus unless receptacles of two separate lines are provided close to the installation location. Thus, conventionally, it is difficult to increase the upper limit of the supply power so as to raise the temperature of the heat roller (heating means) in a short time.

In the above-mentioned circumstance, as a method of realizing prevention of the temperature decrease of the fixing device by increasing a maximum supply power, there is suggested an image forming apparatus having a rechargeable auxiliary power supply device, which is different from the commercial power supply (100V/15 A). For example, in the following Patent Document 1, a plurality of heaters are provided to heating means as a heat-generating member as shown in FIG. 1, and an electric power is supplied to one of the heating members from a commercial power source line, which serves as a main power supply device, and an electric power is supplied from an auxiliary power supply device to the other heating member so as to increase a maximum supply power to the heating means to achieve a reduction in the standup time and prevent a temperature decrease. As the auxiliary power supply source, there is typically a secondary battery such as a lead battery or a nickel-cadmium battery. However, the secondary battery deteriorates and the capacity thereof is reduced while repeating charge and discharge, and a service life is shortened as a discharge is carried out with a large current.

Even the nickel-cadmium battery, which is generally considered to have a long service life with a large current, a number of repetitions of charge and discharge is about 500 to 1000 times. For example, if charge and discharge are repeated for twenty timed per one day, the service life will expire after use of about one month. This requires labor of replacing the battery, and a running cost such as a battery cost is very high. Further, from viewpoint of a charge time, since it requires a long time to charge a large-capacity battery, such a battery cannot be used for an application in which charge and discharge are repeated in a day. Thus, it is difficult in practice to use the secondary battery. As mentioned above, since there are problems in use of a secondary battery in practice, the Patent Document 1 also discloses use of a capacitor having a large capacity such as an electric double layer capacitor.

The large-capacity capacitor has the following advantages as compared to a battery. First, a number of repetitions is more than several million times, which is almost no limitation, and there is little deterioration of the charge characteristic and a periodic maintenance is not needed. Second, the charge time can be set to several seconds to several tens seconds while that of the secondary battery is several hours. Additionally, the electric double layer capacitor is capable of flowing a large current such as several tens amperes to million amperes, which enables a large power supply in a short time.

As another method of using the auxiliary power supply device, there is a method disclosed in the following Patent Document 2. In the Patent Document 2, as shown in FIG. 2, a power supply device, which supplied DC 5V or 24V to an image forming apparatus from the commercial power source line (100V/15 A), and a charge device, which supplies an electric power from a rechargeable battery as an auxiliary power supply device, are provided to supply a power from the both to a main control part so as to reduce a load to the power supply device by an amount corresponding to the power supplied by the rechargeable battery, which achieves a reduction in a maximum power supply of the power supply device.

Patent Document 1: Japanese Laid-Open Patent Application No. 2003-140484

Patent Document 2: Japanese Laid-Open Patent Application No. 2002-044305

According to the method of supplying an electric power to the auxiliary heater such as disclosed in the Patent Document 1, the auxiliary heater is needed in addition to the main heater as a heat-generating member of the heating means, and, thus, there is a limitation in reduction of a size of the heating means. Additionally, as shown in FIG. 3, since a large electric power (for example, 1900 W), which is a sum of a maximum power (for example, 1200 W) of the main heater serving as a main heat-generating part and a maximum power (for example, 700 W) of the auxiliary heater, can be supplied to the heat-generating member, it is considered that an excessive temperature rise is invited when the apparatus runs out of control in the case of the heating means having a structure in which a heat capacitance is decreased in consideration of a startup characteristic.

In the Patent Document 2, in order to always supply electric power during an image forming operation using a battery with a sufficient margin in a charge current, a sufficiently large charge current is needed. Thus, it is difficult to use a charge device having a relatively small capacity such as an electric double layer capacitor, and a charge device which cannot acquire a sufficient capacity such as a capacitor cannot be used as an auxiliary power supply device. Additionally, it is difficult to miniaturize the charge device by reducing the charge current to the battery. Thus, it is not suitable for an application of an image forming apparatus of a short time temperature raise or a high-speed print. Additionally, if the image forming apparatus is equipped with a device such as a hard disk drive or a stapler, which requires a large electric power instantaneously from an auxiliary power supply device, it is difficult to increase an electric current supplied to the heating means. Thus, it is not suitable for an application to an image forming apparatus of a short time temperature raise or a high-speed print.

Moreover, although a system can be achieved within a limited electric power of a commercial power supply line by supplying a required electric power from an auxiliary power supply even in a case where a large electric power is required instantaneously for operating a hard disk drive (HDD) or a stapler such as shown in FIG. 4, it is difficult to increase an amount of power supply to the fixing device in such an application to supply an auxiliary electric power to a specific device, and the short time temperature raise or a high-speed print cannot be achieved.

SUMMARY OF THE INVENTION

It is a general object of the present invention to provide an improved and useful heating device and fixing device, in which the above-mentioned problems are eliminated.

A more specific object of embodiments of the present invention is to provide an electric power supply control device of a heating device and a fixing device, which is small and has a high-safety while enabling a temperature rise in a short time by increasing an electric power usable by heating means.

Another object of embodiments of the present invention is to provide an electric power supply control device of a heating device and a fixing device, which can supply a stable electric power to heating means even when a device having a small charge current is used.

A further object of embodiments of the present invention is to provide a fixing device and an image forming apparatus, which is small and has a high-safety while enabling a temperature rise in a short time by increasing an electric power usable by heating means and capable of achieving a high-speed printing.

In order to achieve the above-mentioned objects, there is provided according to one aspect of the present invention an electric power supply control device comprising: an electric power supply part supplying electric power to a heat-generating member, which generates heat by electric power being supplied thereto, and to an electric power requiring part, which requires electric power to operate; a control part controlling electric power supplied to the heat-generating member and the electric power requiring part; and a main electric power supply device and an auxiliary electric power supply device provided in the electric power supply part, wherein the control part includes: a first electric power supply mode to supply electric power to the heat-generating member from only the main electric power supply device and supply electric power to the electric power requiring part from both the main electric power supply device and the auxiliary electric power requiring part; and a second electric power supply mode to supply electric power to the heat-generating member and the electric power requiring part from only the main electric power supply device and causing electric power supplied to the heat-generating member to be smaller than a rated electric power of the heat-generating member, wherein the electric power supplied to the heat-generating member in the first electric power supply mode is caused to be larger than the electric power supplied to the heat-generating member in the second electric power supply mode.

According to the above-mentioned electric power supply control device, electric power is supplied to the heat-generating member from only the main electric power supply device. That is, there is no need to provide an auxiliary heater to which electric power is supplied from the auxiliary electric power supply device. Additionally, a maximum electric power to the heat-generating member can be reduced, which improves safety while attempting miniaturization of the device. Further, since the heat-generating member does not receive electric power from the auxiliary electric power supply device, an amount of electric power required to the auxiliary electric power supply device can be reduced. If the auxiliary electric power supply device is constituted by a plurality of capacitors, a capacitance of each of the capacitors can be increased to reduce a number of cells, which enables attempting further miniaturization.

Other objects, features and advantages of the present invention will become more apparent from the following detailed description when read in conjunction with the accompanying drawings.

DETAILED DESCRIPTION OF THE PREFERRED EMBODIMENTS

A description will be given below, with reference to the drawings, of embodiments of the present invention.

Figure 1:
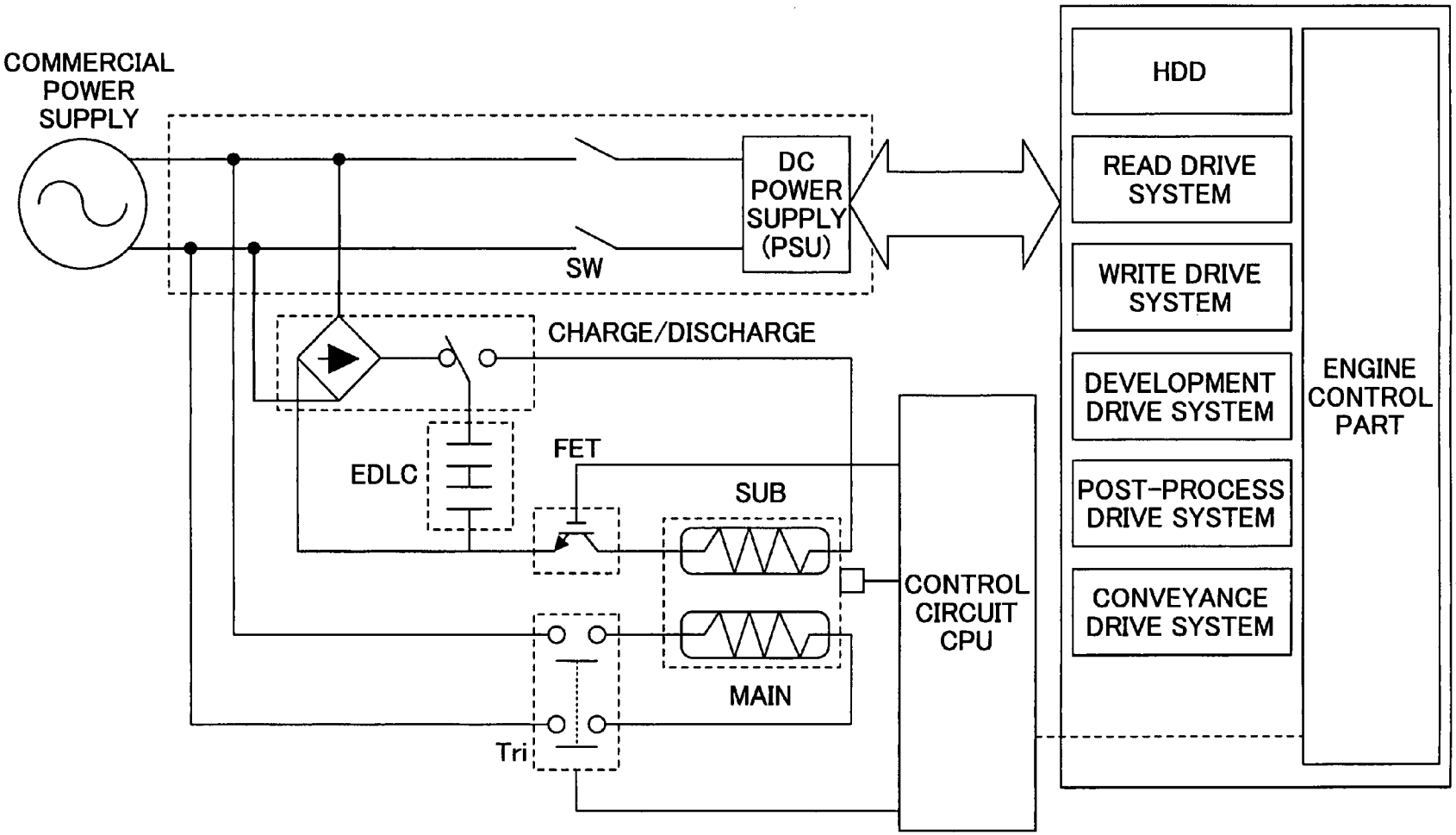
FIG. 1 is a block diagram of a device and a conventional heating power supply for supplying an electric power to the device, the heating power supply including a main heat-generating member and a sub heat-generating member.
Figure 2:
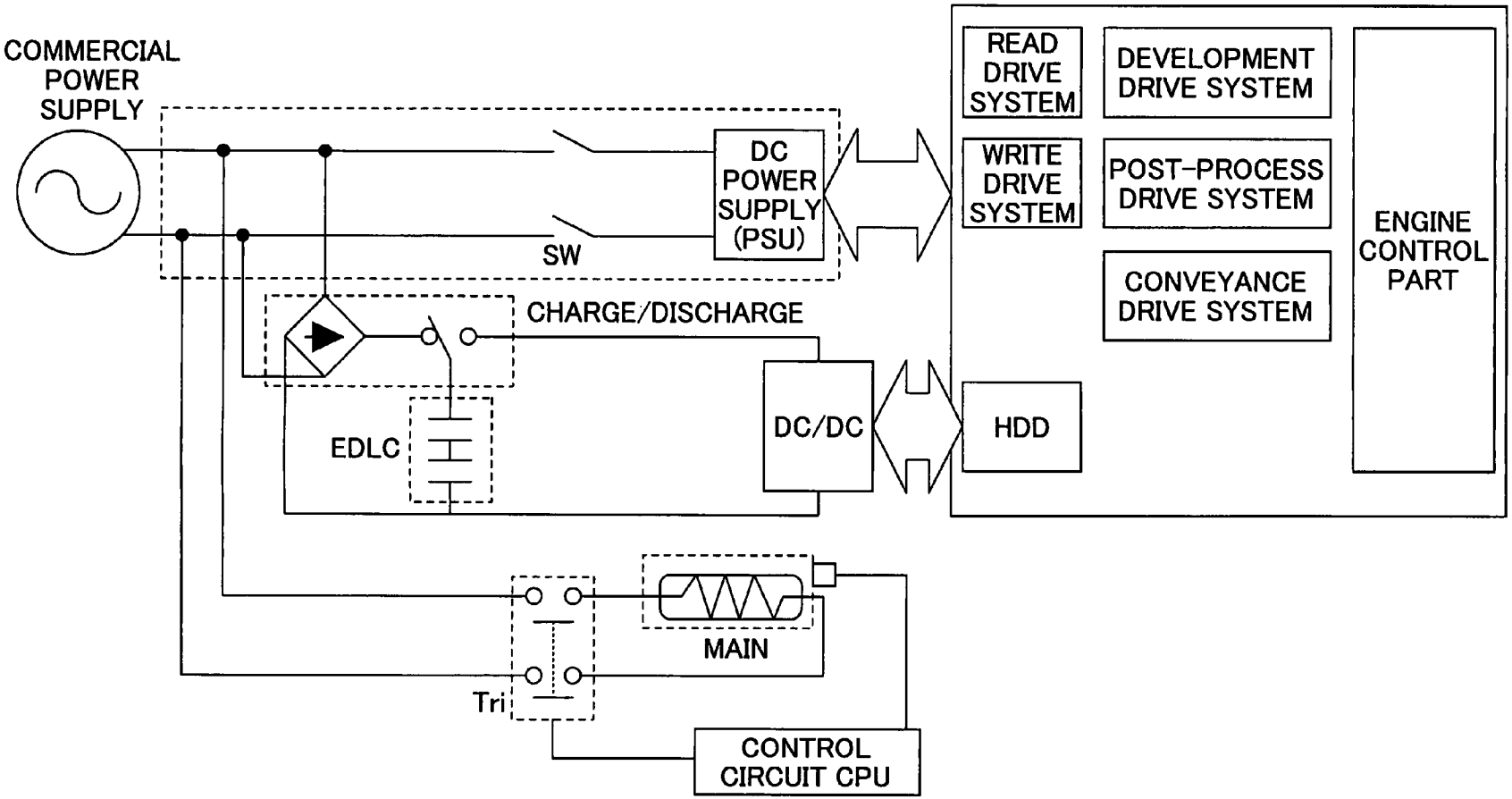
FIG. 2 is a graph showing a power supply pattern according to the structure shown in FIG. 1.
Figure 3:
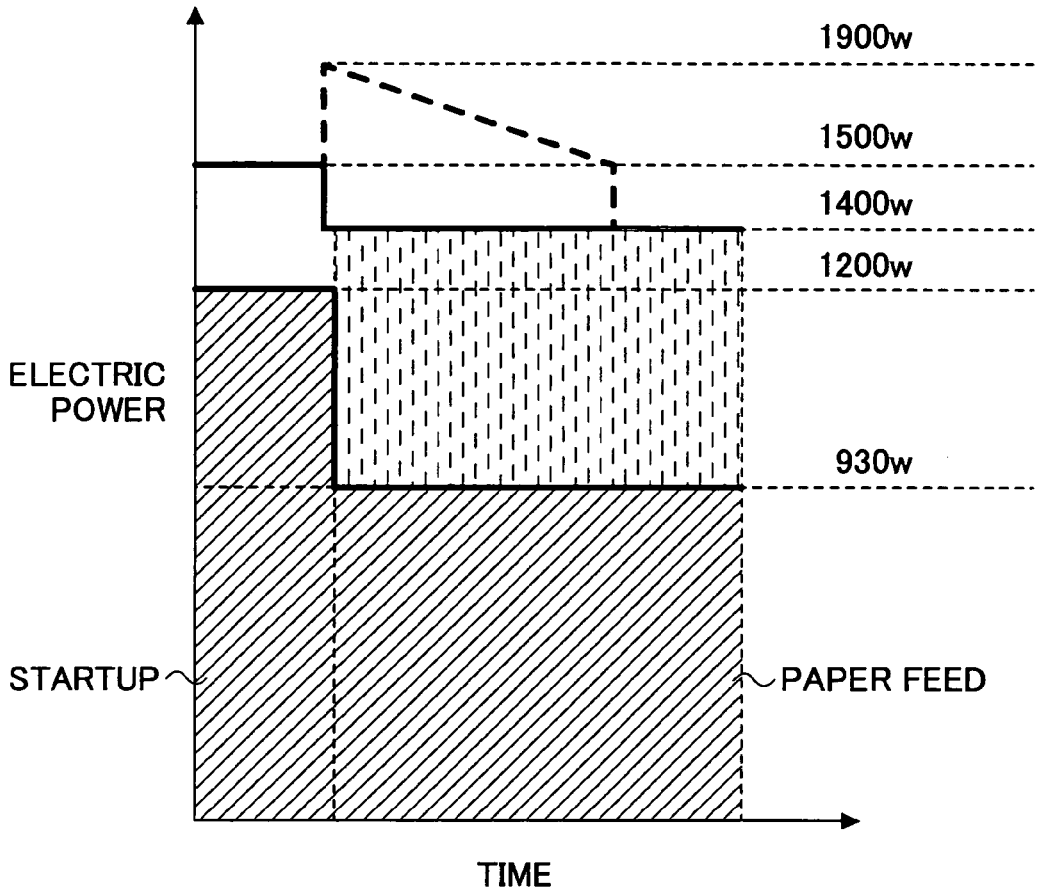
FIG. 3 is a block diagram a device and a conventional heating power supply for supplying an electric power to the device, the heating power supply supplying an electric power from a main power supply device to a heat-generating member and a drive system of an image forming apparatus.
Figure 4:
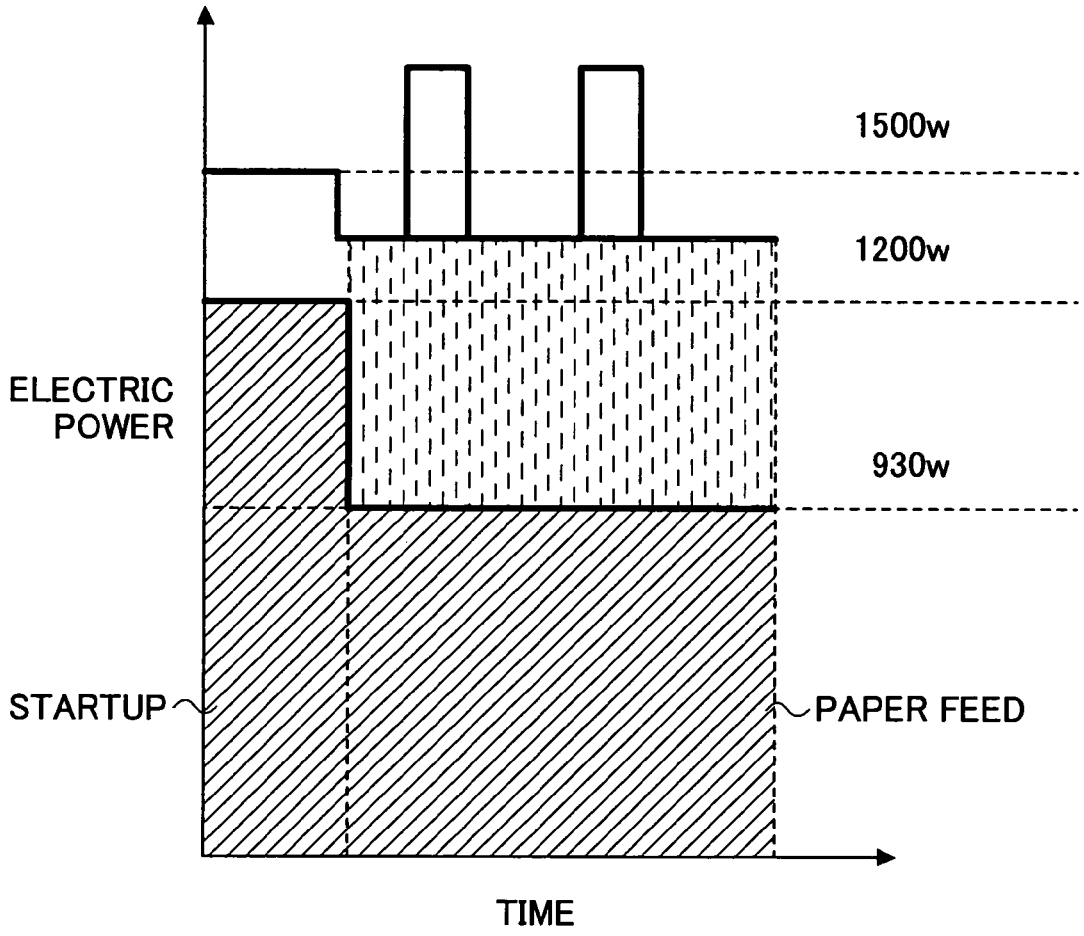
FIG. 4 is a graph showing a power supply pattern according to the structure shown in FIG. 1.
Figure 5:
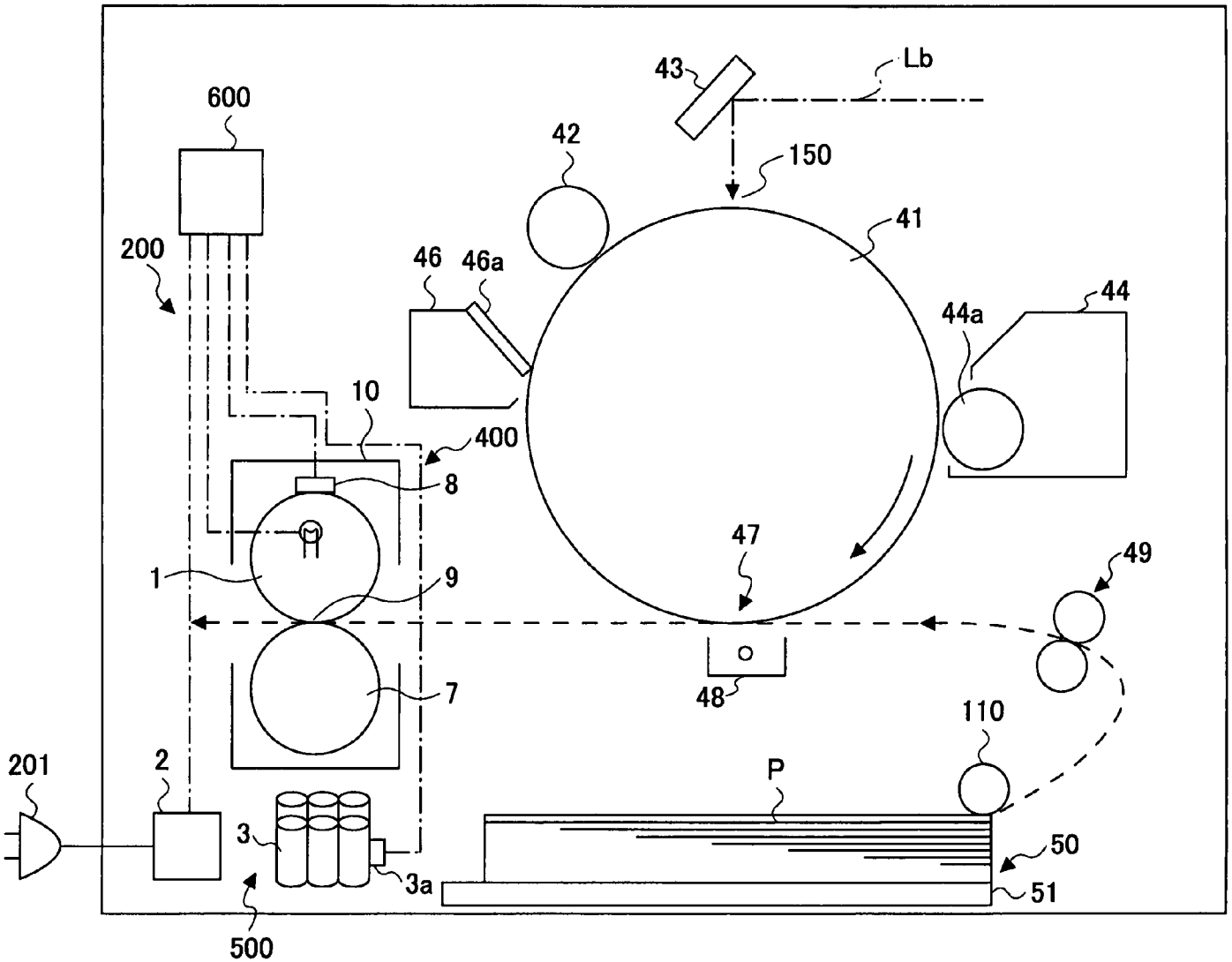
FIG. 5 is an outline structural diagram of an image forming apparatus according to an embodiment of the present invention.

FIG. 5 is an outline diagram of an image forming apparatus to which the present invention is applied. In FIG. 5, the image forming apparatus is provided with a drum-shaped photosensitive member 41 as an electrostatic latent image carrier (image carrier) in a main body thereof. The photosensitive member 41 is configured and arranged to be rotated by a drive motor (not shown in the figure) in a clockwise direction indicated by an arrow in the figure. Arranged around the photosensitive member 41 in a rotating direction of the photoconductive member 41 are a charge device 42 uniformly charging the surface of the photosensitive member 41, a development device 44 having a development roller 44*a* for developing the latent image on the photosensitive member 41, a transfer device 48 for transferring the image (toner image) on the photosensitive member 41 onto a recording paper P, which is a recording material as a material to be heated, and a cleaning device 46 for cleaning the surface of the photosensitive member 41.

A write system laser light Lb as an exposure light is irradiated onto an exposure part 150 between the charge device 42 and the development device 44 on the surface of the photosensitive member 41 uniformly charged by the charge device 42 by being reflected by a reflection mirror 43. Thereby, a latent image is formed on the surface of the photosensitive member 41. The write system laser light Lb is irradiated from a known write unit comprising the reflection mirror 43 and a polygon mirror (not shown in the figure). The latent image formed on the surface of the photosensitive member 41 is visualized by receiving a toner as a developer by the development roller 44*a* of the development device 44.

The transfer device 48 is arranged opposite to the surface of the photosensitive member 41 so as to form a transfer part 47 therebetween. A recording paper P is conveyed to the transfer part 47 from a paper supply tray 51 of a paper supply device 50 through a paper feed roller 110 and a pair of registration rollers 49 that constitute a conveyance system. A developed image (toner image) on the photosensitive member 41 is electrostatically transferred onto the conveyed recording paper P by a transfer bias applied by the transfer device 48 in the transfer part 47.

The recording paper P onto which the developed image (toner image) has been transferred is conveyed to a fixation device 10 arranged on a downstream side of the transfer part 47 by conveyance rollers (not shown in the figure) constituting the conveyance system. The fixation device 10 is provided on a paper conveyance path indicated by a dashed line in the figure. The fixation device 10 comprises a heat roller 1 and a pressure roller 7 as an opposing rotation member arranged opposite to the heat roller 1. The heat roller 1 serves as a heating member and also a fixing member, which is heated by receiving electric power supply from an electric power supply control device 200 mentioned later. The heat roller 1 and the pressure roller 7 together form a pressure-contact nip portion 52 for fixing by being brought into contact with each other. When the recording paper P is conveyed to the fixation device 10 and passes through the nip portion 52, the toner image on the recording paper P is thermally fixed to the recording paper P due to a heat from the heat roller 1 and a pressure applied in the pressure-contact nip portion 52, and, then, the recording paper P is ejected onto a paper eject tray (not shown in the figure).

The toner not transferred and remaining on the photosensitive member 41 reaches the cleaning device 46 with the rotation of the photosensitive member 41. Then, the remaining toner is scratched off and cleaned by a cleaning member 46*a* when passing between the cleaning member 46*a* of the cleaning device 46 and the photosensitive member 41.

Figure 6:
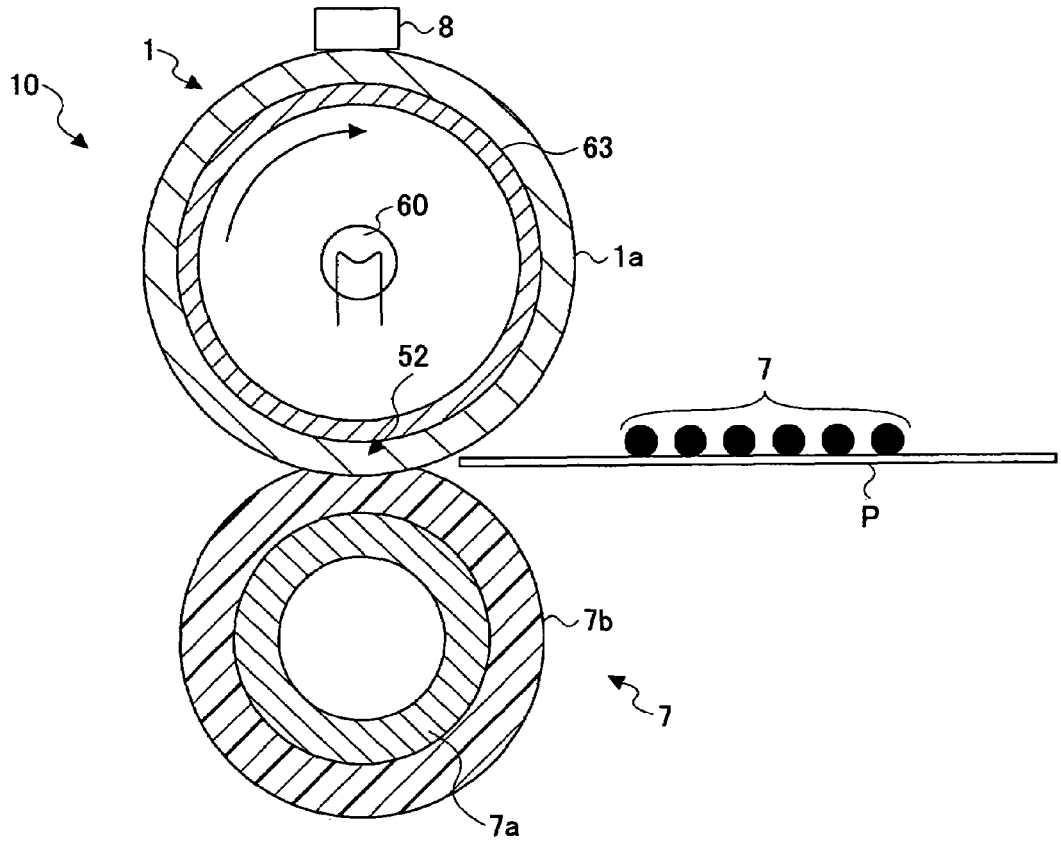
FIG. 6 is a cross-sectional view of a roller-fixing type fixing device according to the present invention.
Figure 7:
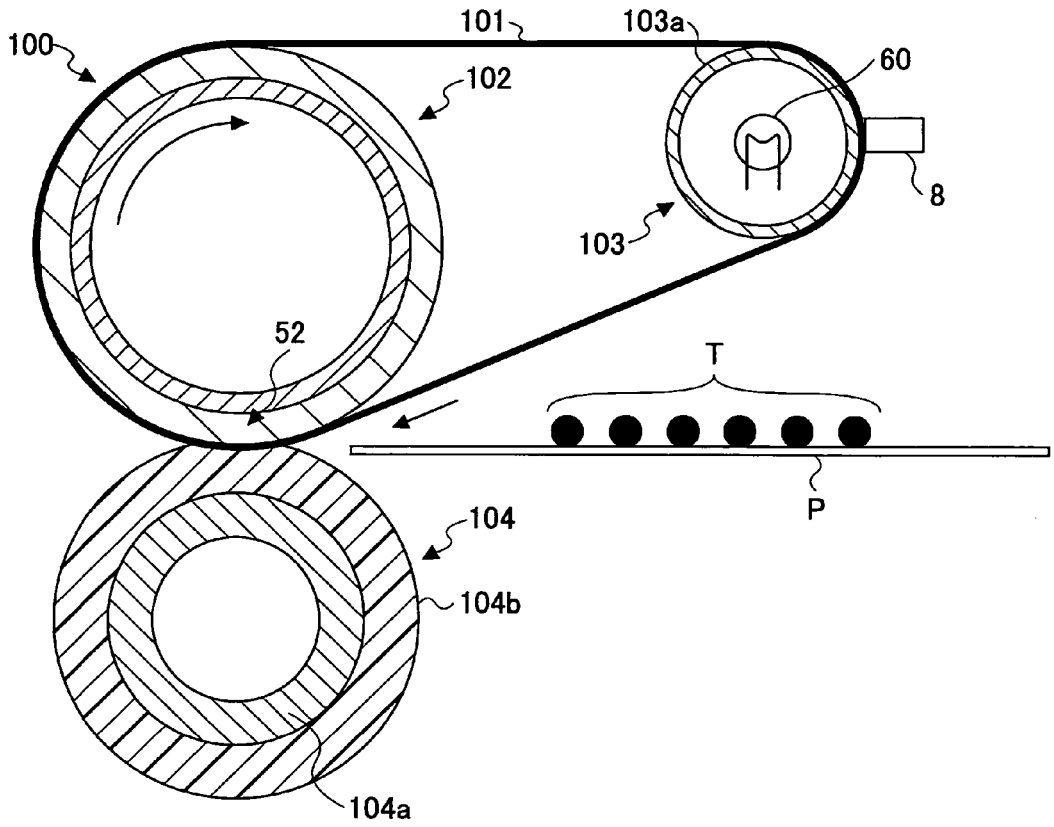
FIG. 7 is a cross-sectional view of a belt-fixing type fixing device according to the present invention.

A description will now be given of the fixation device and component parts relating to the fixation device. As the fixation device, there are a roller fixing method as shown in FIG. 6 and a belt fixing method as shown in FIG. 7. Although the fixation device 10 of the image forming apparatus shown in FIG. 5 uses the roller fixing method shown in FIG. 6, the belt fixing method shown in FIG. 7 may be used.

The fixation device 10 comprises the heat roller 1 rotated by a drive source (not shown in the figure) and the pressure roller 7 being brought into pressure-contact with an outer surface of the heat roller 1 to form the pressure-contact nip portion 52. The fixation device 10 fixes the toner image on the recording paper P due to heat and pressure by introducing the recording paper P on which the toner image has been transferred into the pressure-contact nip portion 52. The heat roller 1 includes a halogen heater 60 as a heat-generating member therein. A temperature of the surface of the heat roller 1 is raised to a fixing temperature as a predetermined temperature by the halogen heater 60 being supplied with an electric power and generating heat. In FIG. 6, the sign T indicates the toner image before fixed.

The fixation device 100 of the belt fixing method as shown in FIG. 7 comprises: a fixing belt 101 as a fixing member constituted by an endless belt; a fixing roller 102 and a heat roller 103 as a plurality of backup members on which the fixing belt 101 is wound; and a pressure roller 104 as an opposing rotation member forming the pressure-contact nip portion 52 with the fixing roller 102 as one of the rollers by sandwiching the fixing belt 101 therebetween. The fixation device 100 fixes the toner image on the recording paper P due to heat and pressure by introducing the recording paper P on which the toner image has been transferred into the pressure-contact nip portion 52. The heat roller 103 is provided with a halogen heater 60 therein so as to constitute a heat-generating member. The heat roller 103 raises a temperature of the surface of the fixing belt 100 to a fixing temperature as a predetermined temperature by the halogen heater 60 being supplied with an electric power and generating heat. The fixation device 100 is configured and arranged so that a drive force is transmitted to the fixing roller 102 and the pressure roller 104 from a drive motor as a drive source (not shown in the figure) so as to convey the recording paper P. Thus, in FIG. 7, the fixing roller 102 is rotated in a clockwise direction and the fixing belt 101 rotates and moves in the same direction, and the pressure roller is rotated in a counterclockwise direction. As the drive system, only one of the fixing roller 101 and the pressure roller 104 may be rotated.

As shown in FIG. 6, the heat roller 1 is provided with the halogen heater 60 inside a metal made cylindrical roller body 63. The halogen heater 60 is configured to raise a temperature of the surface of the heat roller 1 by heating the roller body 63 by radiation heat thereof. The roller body 63 serves as a body of the heat roller 1, and, thus, it is desirous to be made of a metal such a aluminum or iron in consideration of durability and deformation due to a pressure. In the present embodiment, a separation layer 1*a* is formed on an outer circumferential surface of the roller body 63, which is the surface of the heat roller 1, to prevent the toner from adhering onto the heat roller 1. It is preferable to apply a blackening process to an inner surface of the roller body 63 so as to effectively absorb the heat from the halogen heater 60. The pressure roller 7 is formed by a core metal 7*a* and an elastic layer 7*b* such as a rubber formed on an outer circumference of the core metal 7*a* so that the elastic layer 7*b* elastically deforms when the heat roller 1 is brought into pressure-contact with the pressure roller 7 so that the pressure-contact nip portion 52 is formed sufficiently.

As shown in FIG. 7, the diameter of the heat roller 103 is smaller than the diameter of the fixing roller 102. The heat roller 103 is provided with the halogen heater 60 inside a metal made cylindrical roller body 103*a*. The halogen heater 60 is configured and arranged to heat the fixing belt 101 by heating the roller body 103*a* by a radiation heat thereof. The heat roller 103 does not oppose to the pressure roller 104, and functions to give a tension to the fixing belt 101. Thus, a thickness of the roller body 103*a* is smaller than that of the heat roller 1 shown in FIG. 6. Accordingly, the metal part of the heat roller 103 is smaller and thinner so that a heat capacity of the heat roller 103 is smaller than that of the heat roller 1. Thus, there is no need to provide a conventional auxiliary heater. It is preferable to apply a blackening process to an inner surface of the roller body 103*a* so as to effectively absorb the heat from the halogen heater 60. The pressure roller 104 is formed by a core metal 104*b* and an elastic layer 104*b* such as a rubber formed on an outer circumference of the core metal 104*a* so that the elastic layer 104*b* elastically deforms when the heat roller 102 is brought into pressure-contact with the pressure roller 104 so that the pressure-contact nip portion 52 is formed sufficiently.

Figure 9A:
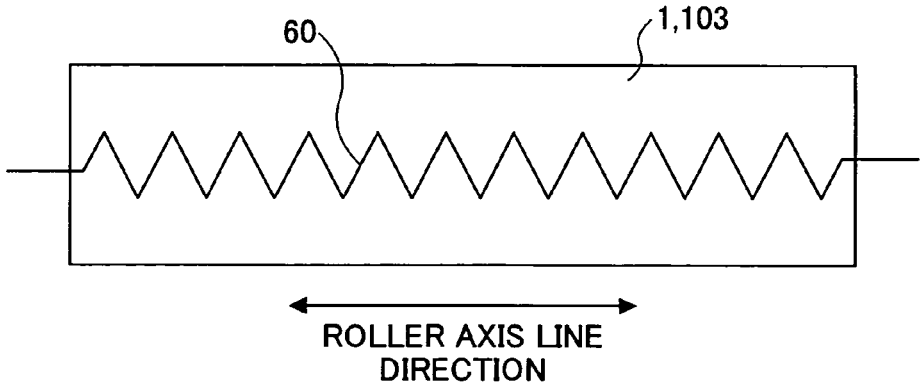
FIG. 9A is an illustration of a heater having a heat-generating member covering an entire area in a roller axis line direction.
Figure 9B:
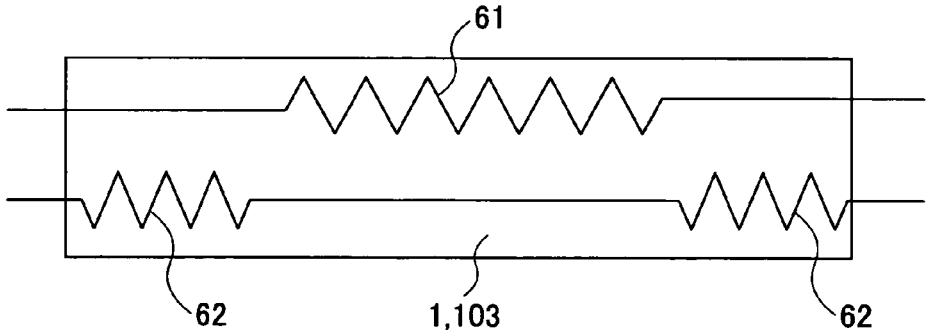
FIG. 9B is an illustration of a heater having heat-generating members displaced in the roller axis line direction.

In the present embodiment, one piece of the halogen heater 60 having an output of 1200 W at 100V is used. The halogen heater 60 may cover an entire area of the heat roller 1 or 103 in the axial direction thereof as shown in FIG. 9A. Or, a first heater 61 for heating only a middle portion of the heat roller 1 or 103 and a second roller 62 for heating both end portions of the heat roller 1 or 103 may be provided as shown in FIG. 9B so as to prevent portions of the roller other than that contacting with a recording paper from being heated by controlling electric power supplied to the heaters in accordance with a size of the recording paper. In such as case, one of the heaters does not serve as an auxiliary heater, but both serve as a main heater.

Although each heating member is heated by the halogen heater 60 as the heat-generating member in the present embodiment, the heating structure is not limited to such a structure. For example, a plate-shaped ceramics heater may be arranged inside the heat roller 1 or 103. Alternatively, a magnetic flux generating part 700 may be formed by winding a coil 702 on an arc-shaped core 701 so as to heat the core 701 by an alternative magnetic field by supplying a high-frequency current to the coil 702. In such a case, the heating member is formed by the coil 702 and the heat-generating member is formed by the core 701. In such a heating structure, the heat roller 103 itself may not be heated.

A merit of using the magnetic flux generating part 700 as the heating means is that an adjustment of electric power is easy. Generally, an ON/OFF control or a phase control or a zero-cross control is used to adjust electric power to the halogen heater 60. A control of an output of the halogen heater 60 is performed by adjusting an average electric power by mixing ON-time and OFF-time. Thus, it is preferable for temperature rising characteristic (standup characteristic), but it is difficult to adjust the electric power precisely. On the other hand, according to the inductive heating, an output electric power for heating can be changed by varying the frequency of the current supplied to the coil 702, which gives a merit that and adjustment of the electric power is easy.

A description will now be given of structures of the electric power supply control device 200 serving as heat generation control means and a heating device 400. Although the heat roller 1 of the fixation device 10 using the roller fixing method shown in FIG. 6 is used in the present embodiment, the heat roller 103 of the fixation device 100 may be used.

Figure 10:
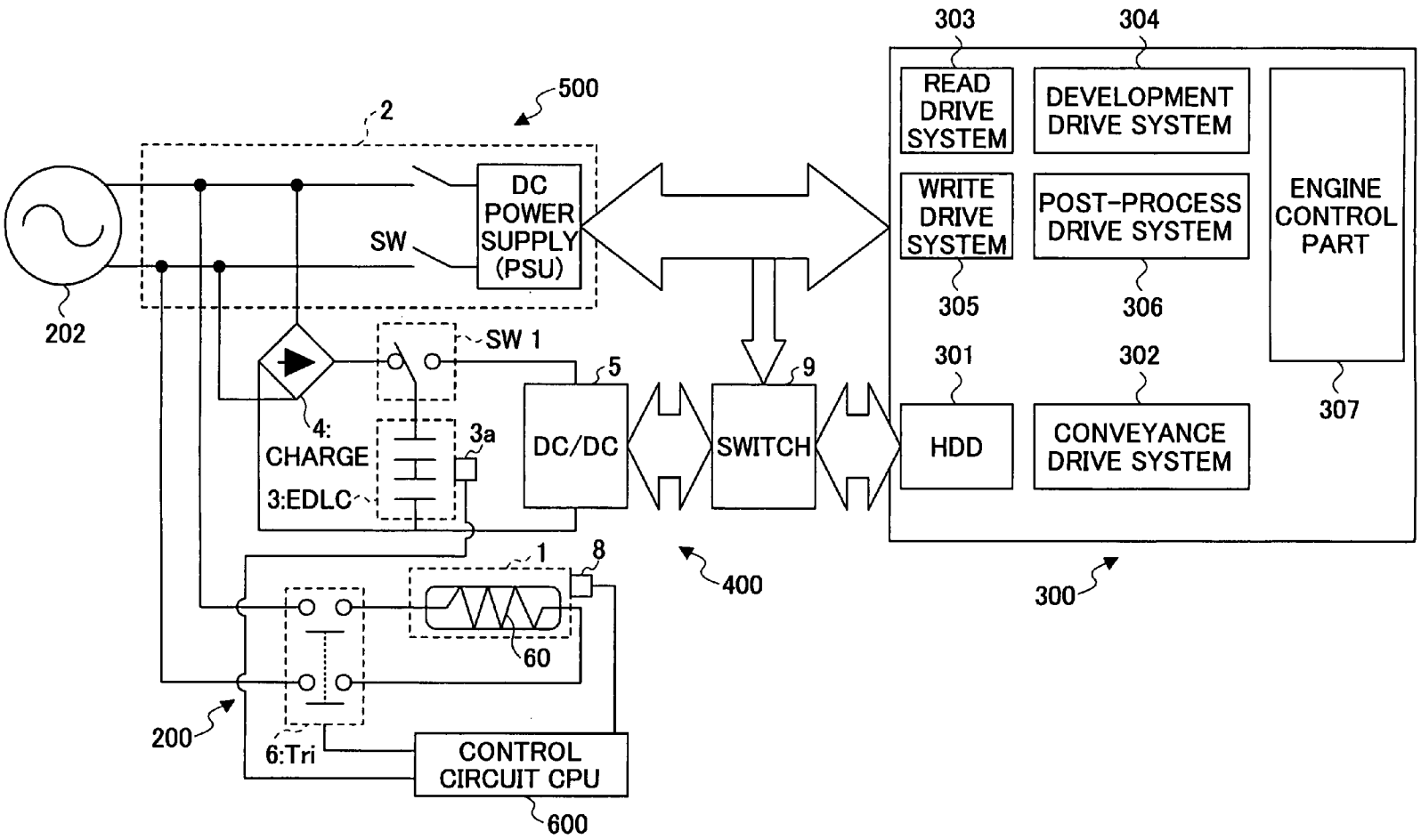
FIG. 10 is a block diagram of a system including a heating device, a fixing device to which electric power is supplied from the heating device and a drive system serving as an electric power requiring part of an image forming apparatus.

As shown in the FIG. 5, the image forming apparatus comprises the electric power supply control device 200 as the heat generation control means and the heating device 400. As shown in FIG. 10, the heating device 400 comprises: the heat roller 1 having the halogen heater 60 for generating heat by electric power supplied thereto; an electric current supply part 500 for supplying an electric current to a plurality of drive systems 300 that constitute the image forming part serving as an electric power requiring part consuming electric power; and a control part 600 for controlling the electric current supply part 500.

As shown in FIG. 10, the electric current supply part 500 comprises: a main electric power supply device 2 and an auxiliary electric power supply device 3; a charger 4 for changing the auxiliary electric power supply device 3; a voltage adjusting circuit 5 as a constant voltage circuit; a charge/discharge switch SW1; a switch element 6 such as a triac as main electric power control means for controlling electric power from the main electric power supply device 2; and an electric power distribution part 9.

The main electric power supply device 2 acquires electric power through a plug 201 shown in FIG. 5 from a commercial electric power supply source 202, and supplies electric power to the halogen heater 60 and the plurality of drive systems 300 as the electric power requiring part of the image forming apparatus. Since it is limited to about 15 A at a voltage of 100V, for example, in Japan, a maximum electric power from the main electric power supply device 2 is set to about 1500 W.

The auxiliary electric power supply device 3 is constituted by a plurality of capacitor cells connected with each other, the capacitor cells being electric double layer capacitors. The auxiliary electric power supply device 3 is configured and arranged to be charged by the main electric power supply device 2 and supplies electric power exceeding electric power supplied by the main electric power supply device 2 to the drive systems 300 by the charge/discharge switch SW1 being switched at an arbitrary timing when larger electric power is required such as a start up time or a continuous paper feed time.

In the present embodiment, an electric double layer capacitor which is a large capacity capacitor among capacitors is used as a capacitor device used for the auxiliary electric power supply device 3. The large capacity capacitor is referred to as an electrochemical capacitor, and is classified into several kinds according to an operating principle thereof. The large capacity capacitor is generally referred to as a super capacitor or an ultra capacitor, which includes an electric double layer capacitor, a redox capacitor, etc. Considering a service life of a number of charges and discharges, it is preferable to use an electric double layer capacitor although other large capacity capacitors or a combination of the electric double layer capacitors and other large capacity capacitors may be used. Alternatively, battery cells may be used instead of the large capacity capacitors. Unlike a secondary battery, which is another example of the rechargeable auxiliary electric power supply device 3, the capacitor does not use chemical reaction. Thus, the capacitor has the following advantages over the secondary battery.

If a nickel-cadmium battery, which is generally used as a secondary battery, is used for the auxiliary electric power supply device 3, several hours may be required to charge the battery even by a quick charge. Thus, a number of times of large electric power supply is limited to every a few hours and a few times a day, which is not practical. On the other hand, if a capacitor is used for the auxiliary electric power supply device 3, a quick charge of several tens seconds or several minutes can be made. Thus, a number of times of heating using the auxiliary electric power supply device 3 can be increased to a practical number of times.

Since the number of times of repetition of charge and discharge of the nickel-cadmium battery is 500 to 1000 times, the service life is too short for an auxiliary electric power supply device for heating, and labor and cost of replacement may cause a problem. On the other hand, the auxiliary electric power supply device 3 using a capacitor has a characteristic that the number of times of charge and discharge is generally more than one million times, which gives a long service life, and there is less deterioration due to charge and discharge. Additionally, since there is no need to replace or replenish a battery liquid such as in a lead battery, almost no maintenance is required. Since the electric double layer capacitor has an internal resistance smaller than that of the lead battery, it can be used with a large current such as a current exceeding 20 A, and there is a loss smaller than that of a secondary battery such as a lithium battery or a nickel-hydrogen battery, which permits a large electric power being easily obtained. In recent years, an electric double layer capacitor capable of storing a large amount of electric energy has been developed, and use for an electric car is considered. For example, the electric double layer capacitor developed by a Japanese manufacturer has an electrostatic capacitance of about 2000 F at 2.5V. Another manufacturer announced a technique of a nano-gate capacitor having a withstand voltage of 3.2 to 3.5V and an electric energy density of 50 to 75 Wh/kg, which is five to ten times of that of a conventional capacitor.

The charger 4 performs a voltage adjustment of the main electric power supply device according to the auxiliary electric power supply device 3 and an AC/DC conversion so as to charge the auxiliary electric power supply device 3. The heating device 400 includes an operation state detector 3*a*, which is connected to the control part 600 and detect a state of operation of the electric power requiring part. The state of operation of the apparatus indicates a remaining electric power of the auxiliary electric power supply device 3, and the operation state detector 3*a* detects a remaining amount of electric power of the auxiliary electric power supply device 3.

That is, the state of charge of the auxiliary electric power supply device 3 is detected by the operation state detector 3*a*, and when the control part 600 detects a full charge, the charge is stopped. If the control part 600 determines that a charge is not sufficient, the control part 600 controls to start charging. That is, the operation state detector 3*a* serves as auxiliary electric power supply state detecting means for detecting a state of the auxiliary electric power supply device 3.

In the present embodiment, the auxiliary electric power supply device is rated 2.5V-1200 F, and is constituted as a 20V-module in which eight capacitor cells are connected in series, each capacitor cell having an internal resistance of smaller than 5 mΩ, a diameter of ϕ040 mm and a length of 120 mm. In order to obtain a voltage balance of each cell when connecting in series, a long-term stability of operation can be acquired by providing a voltage balance circuit (not shown in the figure). The auxiliary electric power supply device 3 starts a supply of electric power with 200 W at a full-charge state of 20V, and detects the voltage by the operation state detector 3*a*. When the discharge (supply of electric power) progresses to a state where the voltage reaches about a half, that is, about 10V, the control part 600 stops the discharge.

Figure 11:
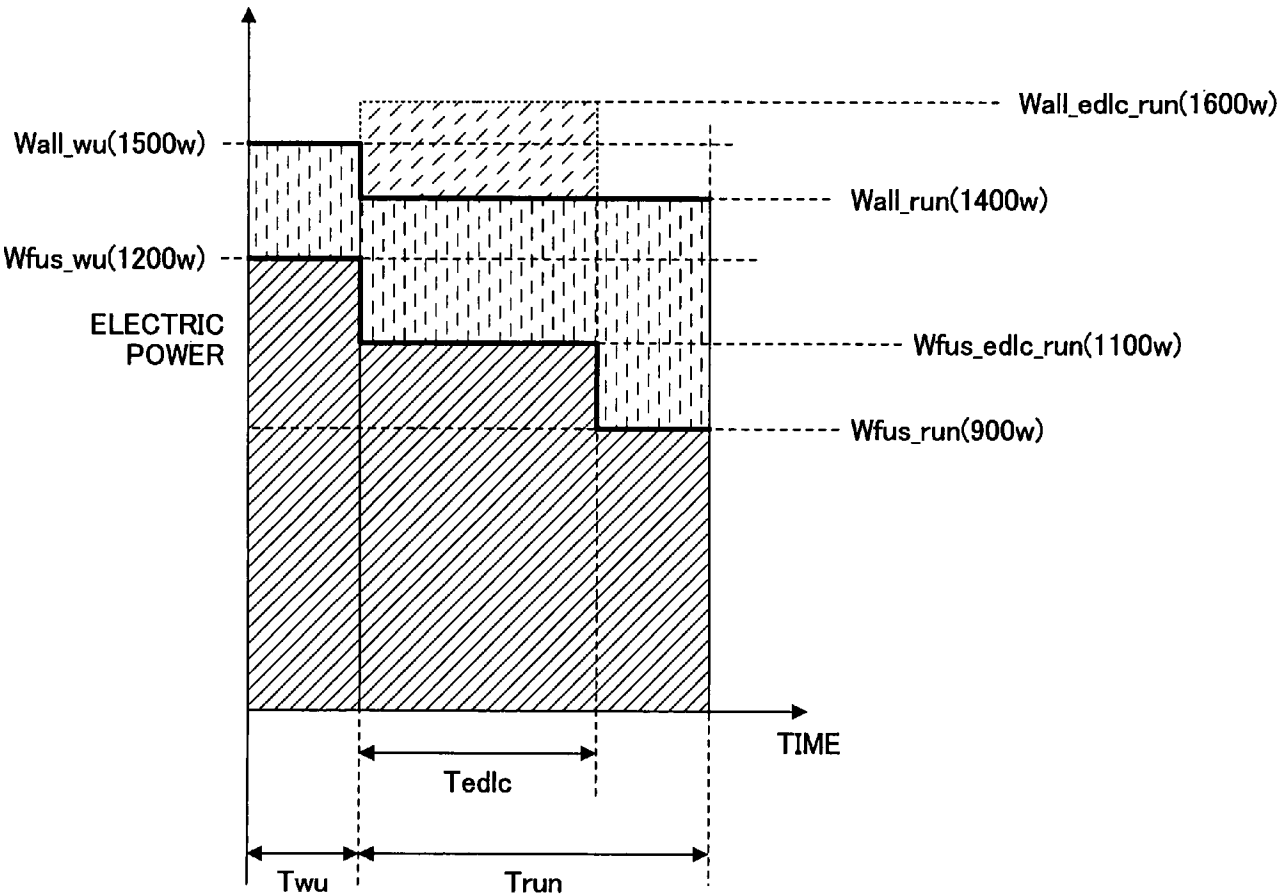
FIG. 11 is an electric power supply pattern using an auxiliary power supply device when feeding a recording material.

An amount of electric power supplied by the auxiliary electric power supply device 3 is smaller than the rated electric power of the halogen heater 60. Additionally, it is configured and arranged to supply electric power within a difference (300 W=1200 W−900 W) between the maximum rated electric power (1200 W) of the halogen heater 60 and an electric power Wfus_run (900 W) in the state where the auxiliary electric power supply device 3 is not used as shown in FIG. 11.

The voltage adjustment circuit 5 has transformation means such as a DC/DC converter, and is configured to adjust the output electric power of the auxiliary electric power supply device 3 to a predetermined voltage according to a load of the image forming apparatus side. The voltage adjustment circuit 5 supplies electric power from the main power supply device to the plurality of drive systems 300 other than the fixation device 10. Although the voltage adjustment circuit 5 has a constant voltage output of DC 24V to supply electric power to the device having a relatively large electric power consumption such as a motor, the output voltage is not limited to the constant voltage. That is, if an allowable input voltage range of the load of the drive systems 300 is large, the output voltage may be varied accordingly.

With the above-mentioned composition, the voltage adjustment circuit 5 has eight 2.5V-rated cells so as to output 24V for the range from 20V to 10V. Thus, the voltage adjustment circuit (DC/DC converter) 5 constitutes a step-up transformer circuit. In a case of increasing an amount of electric power, if the number of cells is increased to 12 pieces and 24V is output for the range of 30V to 15V, functions of both a step-up transformer or step-down transformer can be provided. Or, it may be constituted by 20 cells to output 24V for the range of 50V to 25V to provide a function of a step-down transformer. When constituting a large output electric power of equal to or higher than 400 W, a current output from the capacitor is large in a low-voltage range such as about 10V and a loss is increased. Thus, it is preferable to have a step-up and step-down structure or a step-down structure. The step-down structure is most preferable since the circuit of the DC/DC converter 5 can be simplified.

The switch element 6 is connected to the control part 600. The switch element 600 is turned on by the control part 600 so as to supply electric power to the halogen heater 60 and is continuously turned on and off so as to adjust a total amount of electric power to the halogen heater 60 to adjust an amount of heat generated by the halogen heater 60.

The electric power distribution part 7 is connected to the control part 600, and is configured to switch supply of electric power to the plurality of drive systems 300 from main electric power supply device 2 or from the auxiliary electric power supply device 3. That is, if there is a remaining electric power in the auxiliary electric power supply device 3, the auxiliary electric power supply device 3 supplies electric power to a hard disk drive (HDD) 301 and a conveyance drive system 302 from among the plurality of drive systems 300. Then, when the remaining electric power runs out, a switch control is made to supply electric power from the main electric power supply device 2. Thus, necessary electric power can always be supplied to the hard disk drive (HDD) 301 and the conveyance drive system 302 to set these devices in operable conditions. On the other hand, from among the plurality of drive systems, each drive system other than the hard disk drive (HDD) 301 and the conveyance drive system 302 cannot receive electric power supply from the auxiliary electric power supply device 3, and is always driven by electric power supplied by the main electric power supply device 2.

The control part 600 is constituted by a known computer operation circuit, and comprises memory means such as a ROM and a RAM (not shown in the figure) and a connector to be connected with each device or sensor. The control part 600 has a first electric power supply mode and a second electric power supply mode. In the first electric power supply mode, electric power is supplied to the halogen heater 60 from only the main electric power supply device 2, and electric power is supplied to the plurality of drive system 300 from both the main electric power supply device 2 and the auxiliary electric power supply device 3. On the other hand, in the second electric power supply mode, electric power is supplied to the plurality of drive systems 300 from only the main electric power supply device 2 and electric power is supplied to the halogen heater 60 from only the main electric power supply device 2, and the electric power supplied to the halogen heater 60 is less than a rated electric power (1200 W in the present embodiment) of the halogen heater 60. The control part 600 sets the electric power supplied to the halogen heater 60 in the first electric power supply mode to be larger than the electric power supplied to the halogen heater 60 in the second electric power supply mode. The control part 600 controls the electric power supplied to the halogen heater 60 in the first electric power supply mode to be smaller than the maximum rated electric power (1200 W) of the halogen heater 60.

The control part 600 is provided with a heat generation state detector 8 which detects a state of generation of heat of the heat roller 1. The heat generation state detector 8 is a temperature sensor to detect a temperature of a surface of the heat roller 1, and sends a result of detection to the control part 600. The control part 600 is configured to change an amount of electric power supplied to the plurality of drive systems 300 from the auxiliary electric power supply device 3 in accordance with detection information of the heat generation state detector 8. That is, if a temperature detected by the heat generation state detector 8 is equal to or higher than a predetermined temperature previously set in the control part 600, the control part 600 controls to reduce an amount of electric power supplied to the plurality of drive systems 300 from the auxiliary electric power supply device 3.

The control part 600 controls an amount of electric power supplied to the electric power requiring part from the auxiliary electric power supply device 3 to be suppressed when the remaining electric power detected by the operation state detector 3*a* is lower than a set value previously set. That is, the control part 600 controls each part so as to change an amount of electric power supplied to the electric drive systems 300 from the auxiliary electric power supply device 3 in accordance with the remaining amount of electric power detected by the operation state detector 3*a*, and also to change a productivity of a printed matter. Specifically, if the remaining amount of electric power detected by the operation state detector 3*a* is lower than the set value (including zero) that is previously set, the control part 600 controls to suppress the amount of electric power supplied to the drive systems 300 from the auxiliary electric power supply device 3 and reduce a productivity of a printed matter produced by the image forming apparatus.

A description will now be given of an electric power supply pattern by the heating device 400 having the above-mentioned structure in comparison with a conventional electric power supply pattern.

Figure 8:
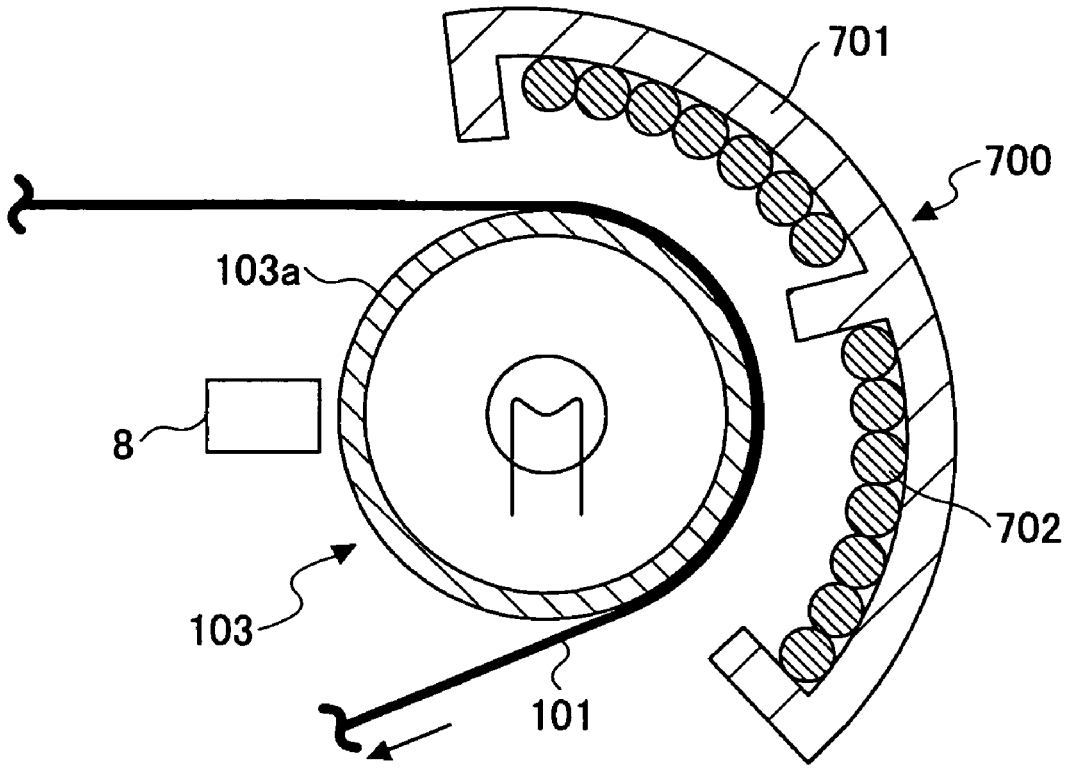
FIG. 8 is a cross-sectional view of a heating unit constituted by magnetic flux generating means.
Figure 12:
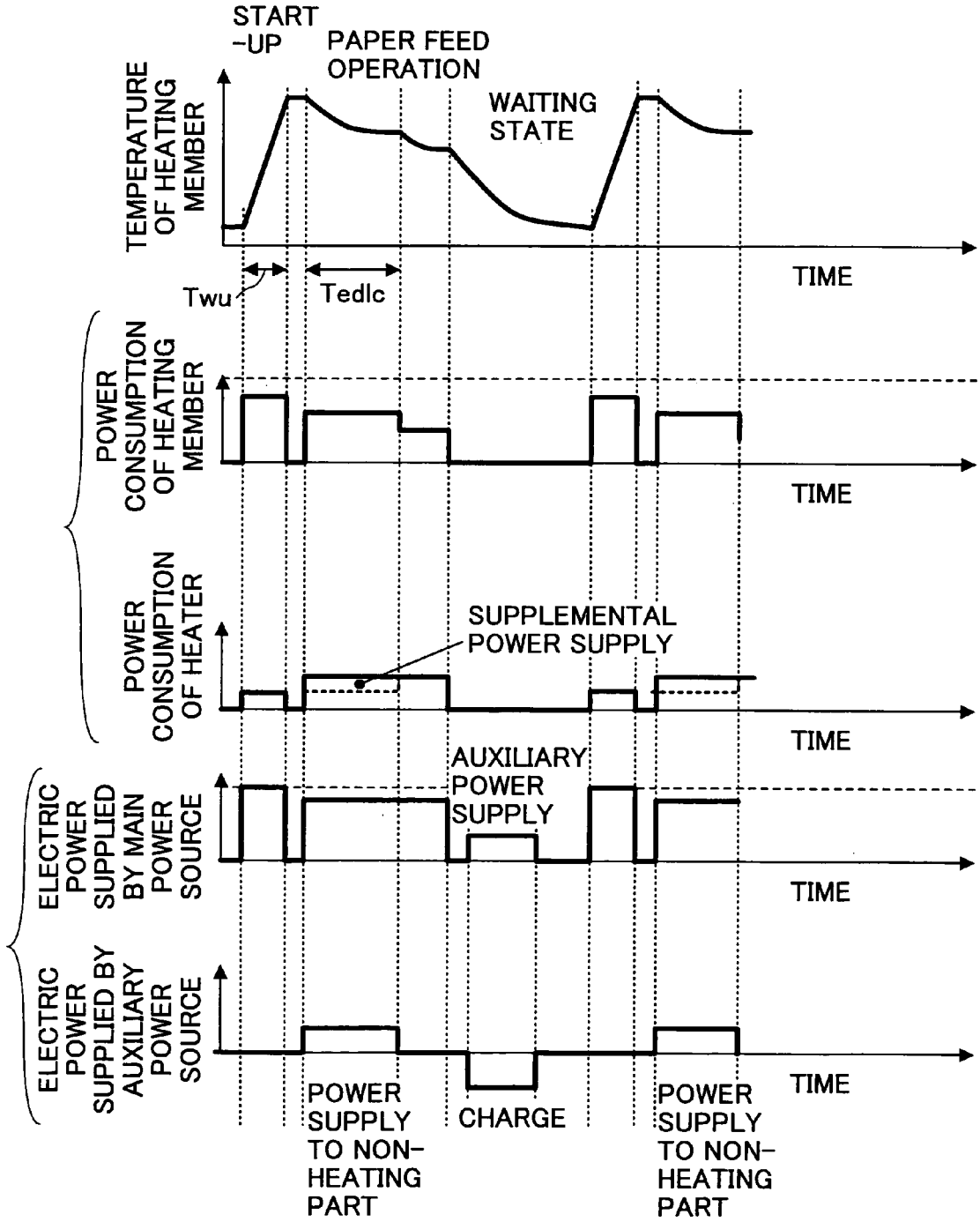
FIG. 12 is a graph showing a relationship between an electric power fluctuation on an electric power supply side, a power consumption on an image forming apparatus side, and a temperature fluctuation of a heat roller.

FIG. 11 is a graph showing a relationship between an operation state and a supplied electric power of the image forming apparatus. In FIG. 7, a vertical axis represents the supplied electric power and a horizontal axis represents a time. FIG. 12 shows a relationship between a temperature of the heat roller 1 (heating member) at a continuous paper feed time, an electric power consumed by the halogen heater 60 and the drive systems 300, which is a non-heated part, and an amount of electric power supplied from each electric power supply device as electric power supplying means. As shown in FIG. 11, in a section Twu where the temperature of the heat roller 1 is rising, a total amount of electric power supplied from the main electric power supply device 2 is 1500 W, which is a sum of 1200 W (Wfus_wu) to the halogen heater 60 and 300 W to the drive systems 300 which are other loads. In this state, the drive systems 300 to be driven are drive systems having a relatively small power consumption such as the hard disk drive (HDD) 301, an engine control part or the like. Thus, at the startup time shown in FIG. 8, the electric power supply by the main electric power supply device 2 alone is sufficient for power consumption by each part.

If printing is started from this state and continuous paper feed is started, it is required to supply electric power to a read drive system 303, a conveyance drive system 302 (motor), a development drive system 304 (motor), a read drive system 305 such as a polygon mirror, and each sensor. Thus, an amount of electric power supplied to the devices other than the halogen heater 60 exceeds 300 W in the startup section, and, for example, about 500 W is required by the drive systems other than the halogen heater 60. The electric power required by the halogen heater 60 is 900 W after the fixation system including the heat roller 1 has been sufficiently heated. This means that printing can be performed with electric power of 1400 W which is a sum of 900 W required by the halogen lamp 60 and 500 W required by the drive systems 300.

However, in order to improve the quick startup characteristic, in the fixing device having the heat roller 1 having a reduced heat capacity, an amount of heat taken by the recording paper P is larger than an amount of heat given to the heat roller 1. Thus, the heat roller 1 cannot be sufficiently heated, and electric power required immediately after the startup is increased. For example, in a case where startup is completed at 30 seconds after the apparatus is turned on and printing is performed at a print speed of about 65 cpm, an electric power of about 1100 W (Wfus_edlc_run) is required by the halogen heater 60 only immediately after the turn on. That is, in order to maintain the temperature of the heat roller 1 by the halogen heater 60 in a fixation temperature range, an electric power of 1100 W (Wfus_edlc_run) is required by the halogen heater 60. In such a case, if the electric power of 500 W required by the drive systems 300 other than the fixation system is supplied, a total of 1600 W is needed, which exceeds the rated electric power 1500 W of the main electric power supply device 2.

However, the large electric power (1100 W: Wfus_edlc_run) for the halogen heater 60 is not always needed, and it is needed only a few minutes immediately after the apparatus is turned on. Thus, as in the present invention, 1100 W (Wfus_edlc_run) can be supplied from the main electric power supply device 2 to the halogen heater 60 during a few minutes in which about 200 W, for example, is supplied from the auxiliary electric power supply device 3 to the drive systems 300.

That is, the electric power supplied from the main electric power supply device 2 to the drive systems 300 can be suppressed to 300 W by supplying 200 W from the auxiliary electric power supply device 3 from the electric power of 500 W consumed by the drive systems 300, which are structural elements of the image forming apparatus other than the fixing device 10. Since the rated electric power of the main electric power supply device 2 is 1500 W (Wall_wu), up to 1200 W (1500 W−300 W=1200 W) can be supplied from the main electric power supply device 2 to the halogen heater 60. Thus, there is a sufficient margin to supply 1100 W (Wfus_edlc_run) to acquire a temperature necessary for fixation.

Figure 13:
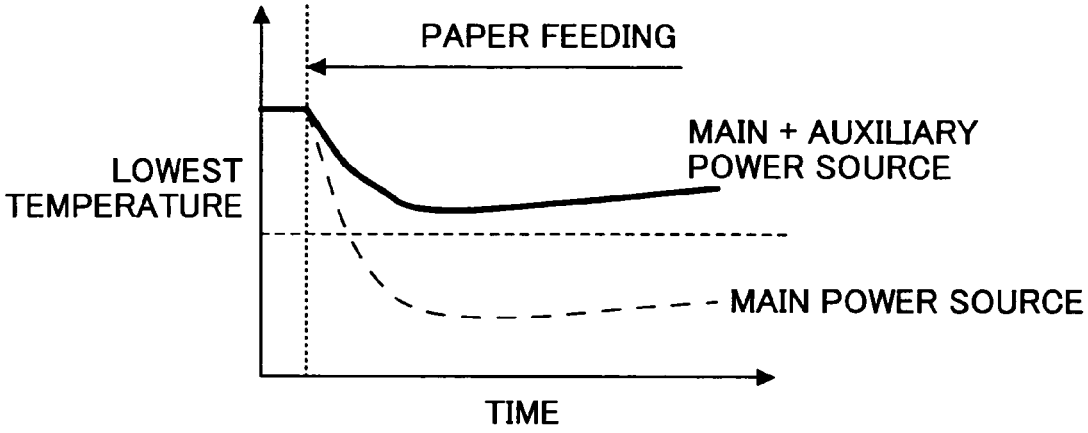
FIG. 13 is a graph showing a change in temperature characteristics of a heating member due to difference between electric power supply means when feeding a recording material.

On the other hand, according to a conventional heat roller which has a thick roller body and a heat capacity thereof is not reduced, an auxiliary heater to which electric power is supplied only from an auxiliary electric power supply device is provided in the roller so as to heat the auxiliary heater to supplement a heat necessary for the heat roller. Thus, in a case where an amount of heat taken by the recording paper P is large during a continuous paper feed time, as indicated by a dashed line in a temperature characteristic graph of FIG. 13 having a vertical axis representing a temperature of the heat roller and a horizontal axis representing a time, the electric power supplied by the main electric power supply device 2 is not sufficient for the electric power for fixation, and there may be a case where the temperature of the heat roller does not reach a predetermined minimum temperature (a minimum temperature enabling fixation). However, in the present embodiment, since electric power is supplied from the auxiliary electric power supply device 3 to the drive systems 300 of the image forming apparatus serving as a system part, a temperature drop of the heat roller 1 can be reduced as indicated by a solid line in the graph of FIG. 13. Thus, the diameter of the heat roller can be minimized, and a stable fixation performance can be achieved and a good image quality can be obtained even when it is applied to an image forming apparatus having a large number of papers fed per unit time, that is, a high printing speed, or a case where the recording paper P having a thickness larger than a regular paper is fed.

According to the present embodiment, the remaining electric power of the auxiliary electric power supply device 3 is detected by the operation state detector 3*a*, and if the remaining electric power is less than a predetermined value (including a case where the remaining electric power is zero) and if an image forming operation is being progressed, the auxiliary electric power supply is stopped so as to reduce a print speed (cpm) corresponding to a productivity of a printed matter, and, thus, a good image quality can be maintained. Additionally, if it is checked whether there is a remaining electric power before printing, a good image quality may be maintained by reducing a print speed (cpm) from a start time of the printing.

Figure 14:
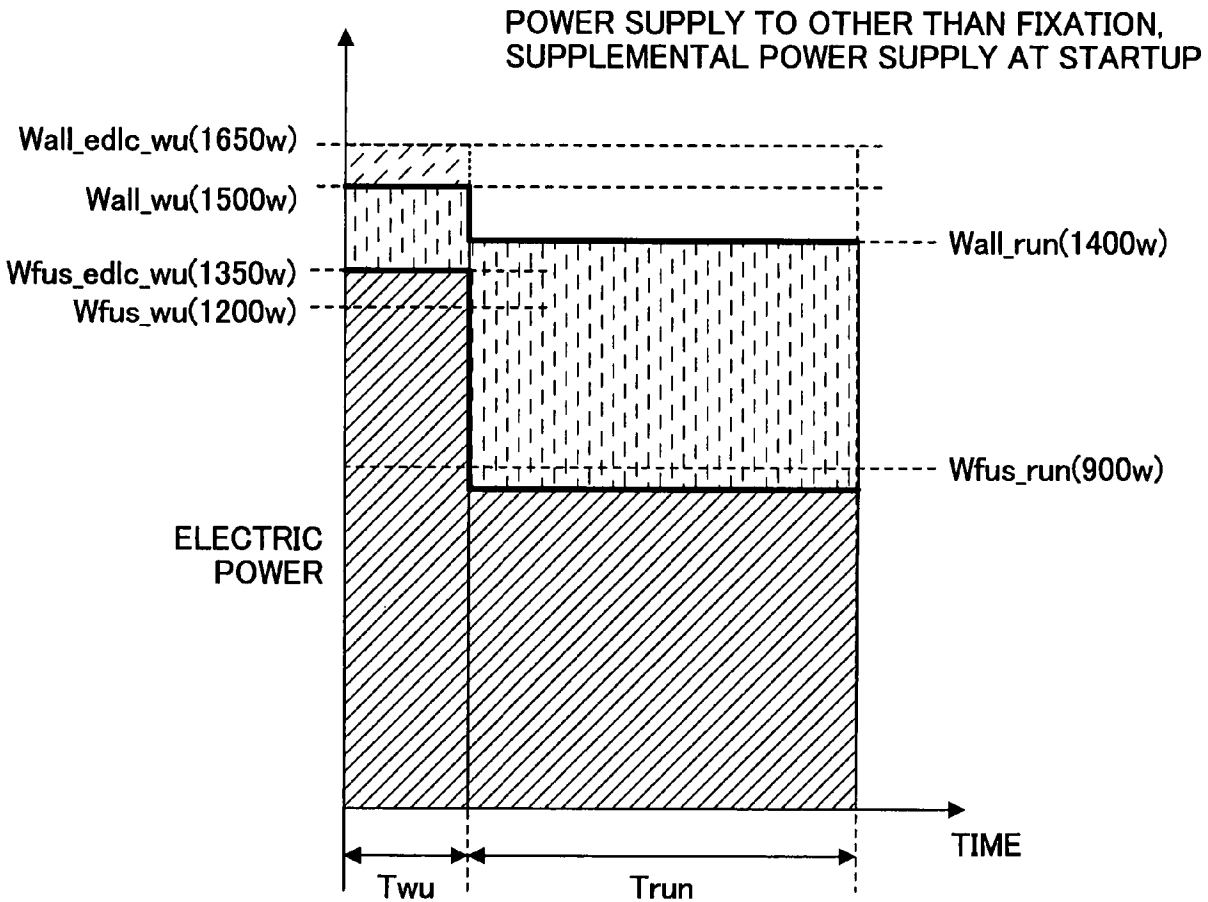
FIG. 14 is a graph showing an electric power supply pattern using an auxiliary electric power supply device on an electric power supply side.
Figure 15:
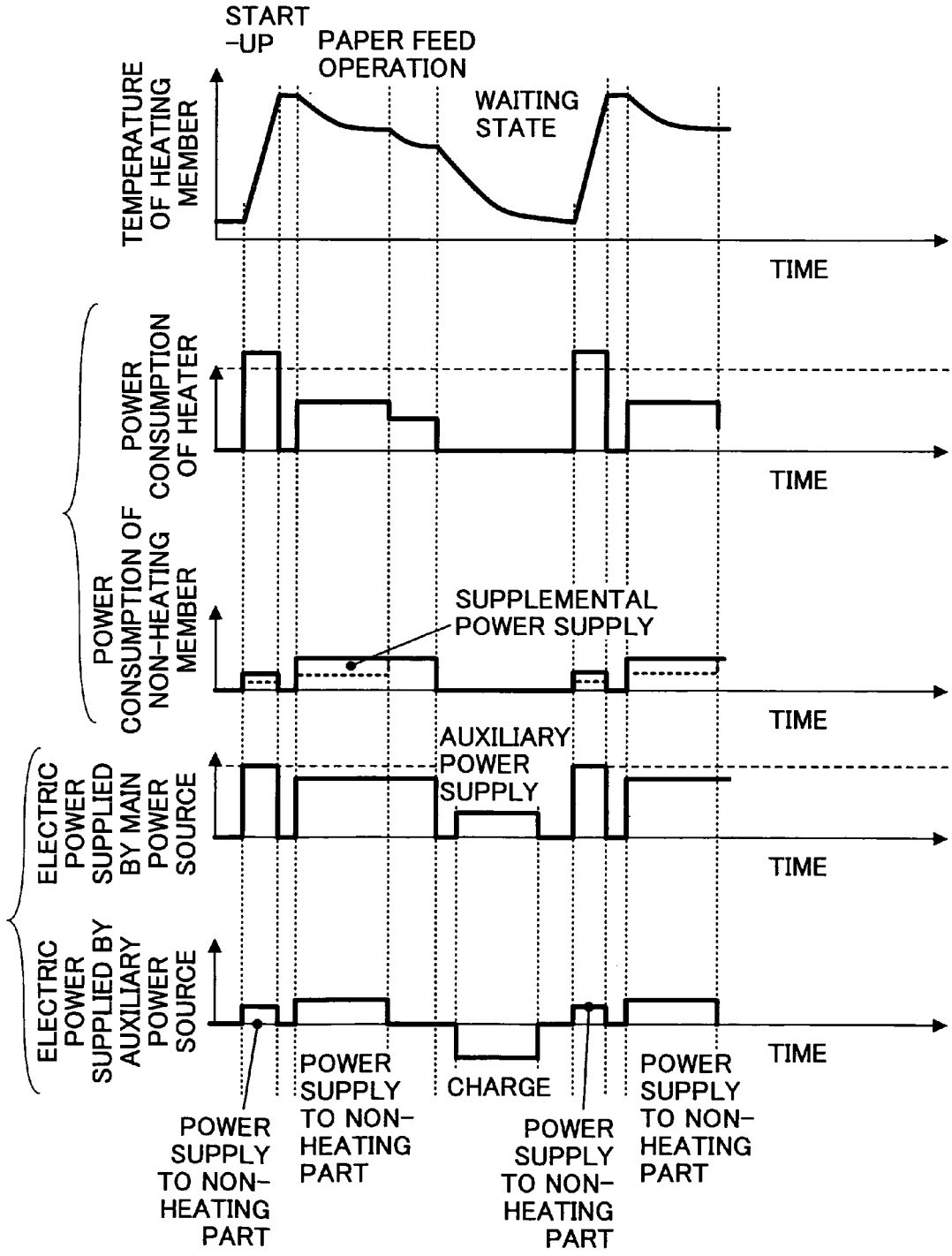
FIG. 15 is a graph showing a relationship between an electric power fluctuation on an electric power supply side, a power consumption on an image forming apparatus side, and a temperature fluctuation of a heating member.
Figure 16:
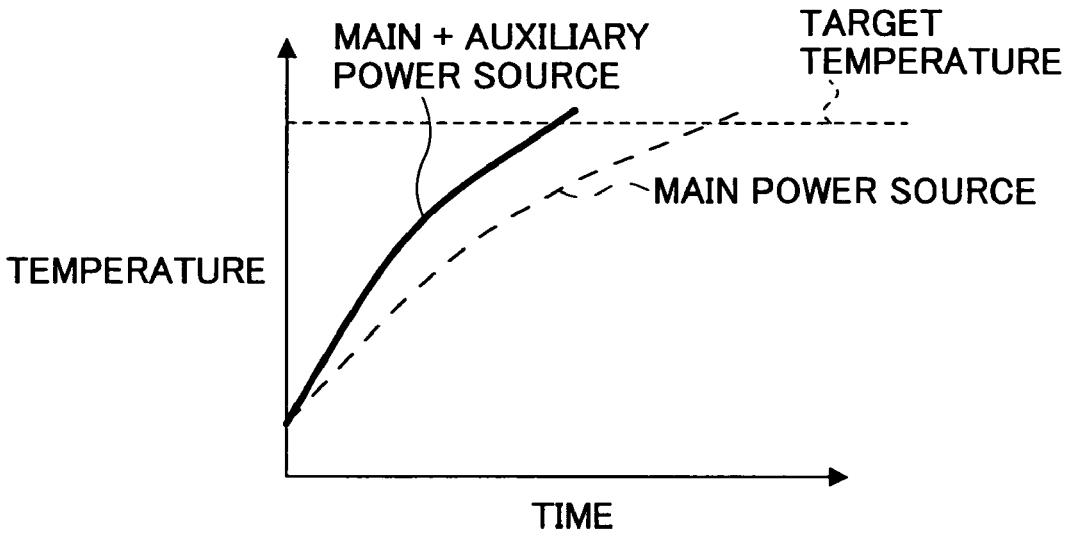
FIG. 16 is a graph showing a change in temperature characteristics of a heating member due to difference between electric power supply means.

As a method of controlling supply of electric power by the control part 600, electric power is not supplied from the auxiliary electric power supply device 3 to the drive systems 300 during a continuous paper feeding time, but electric power is supplied from the auxiliary electric power supply device 3 to the drive systems 300 during a startup time of the apparatus as shown in FIG. 14 through FIG. 16. By doing so, it is possible to reduce a startup time.

FIG. 14 is a graph showing a relationship between the power supply to the drive systems 300 of the image forming apparatus and the auxiliary power supply at the startup time. FIG. 15 shows a relationship between a temperature of the heat roller 1 (heating member) at the time of supplying electric power and the startup time, electric power consumption by the halogen heater 60 and the drive systems 300, which correspond to non-heating members, and electric power supplied from each electric power supply device. FIG. 16 is a graph showing a temperature rising characteristic of the heat roller 1. In FIG. 14, a vertical axis represents a required amount of electric power, and a horizontal axis represents a time. In FIG. 16, a vertical axis represents a temperature of the heat roller 1 and a horizontal axis represents a time.

In FIG. 14 and FIG. 15, when electric power required by the drive systems 300 during the startup time at which there is no electric power supplied from the auxiliary electric power device 3 is set to 300 W and electric power consumed by the fixing system (halogen heater 60) is set to 1200 W, the electric power available for the halogen heater 60 from the main electric power supply device 2 can be increased by setting the rated electric power (Wfus_edlc_wu) of the halogen heater 60 to a larger value, for example, 1350 W, and supplying the increased electric power (150 W) from the auxiliary electric power supply device 3 to the drive systems 300. Thus, as shown in FIG. 16, the temperature rising time can be shortened when using both the main electric power supply device 2 and the auxiliary electric power supply device 3 at the same time to supply electric power to the drive systems 300 from the auxiliary electric power supply device 3 rather than when only the main electric power supply device 2 is used.

Figure 17:
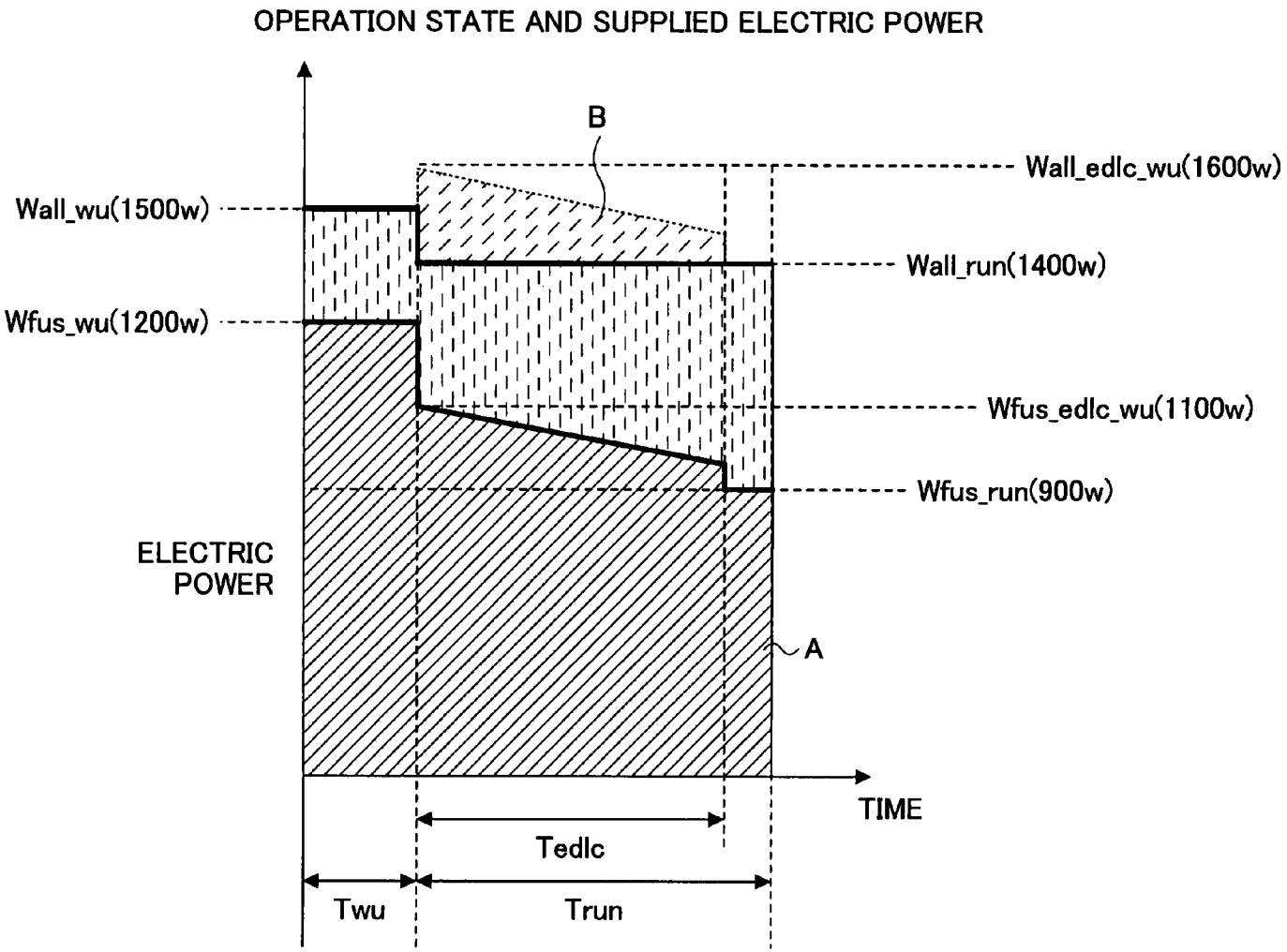
FIG. 17 is a graph showing another electric power supply pattern using an auxiliary electric power supply device.
Figure 18:
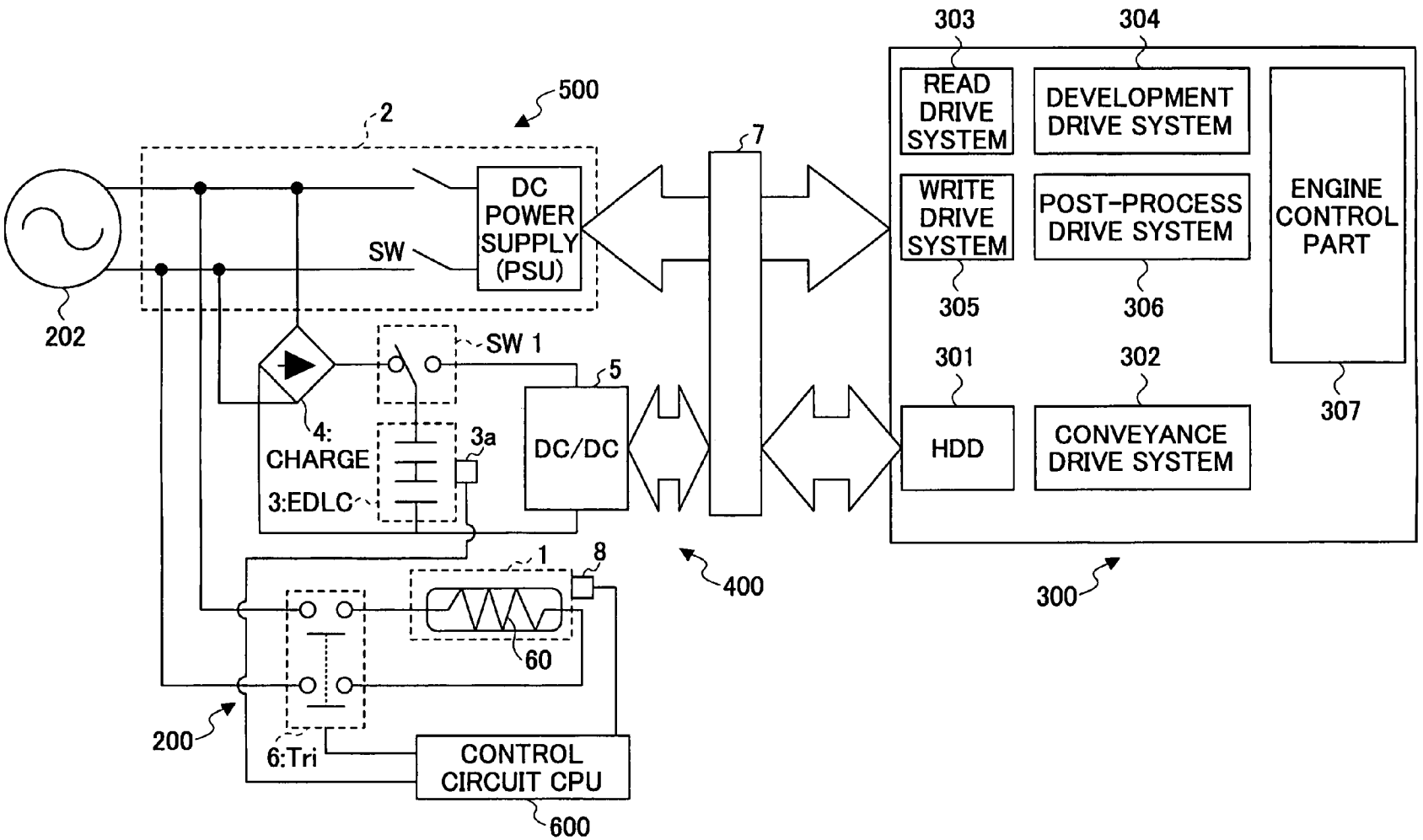
FIG. 18 is a block diagram of another system including a heating device, a fixing device to which electric power is supplied from the heating device and a drive system serving as an electric power requesting part of an image forming apparatus.

FIG. 17 is a graph showing a relationship between a state of operation of the image forming apparatus and electric power supplied thereto. In FIG. 17, a vertical axis represents an amount of electric power, and a horizontal axis represents a time. As a method of supplying electric power by the control part 600, as shown in FIG. 17, it is possible to elongate the electric power supply time from the auxiliary electric power supply device 3 by reducing the electric power supplied from the auxiliary electric power supply device 3 to the drive systems, which are non-heating members, in accordance with a reduction in the electric power required by the halogen heater 60.

In this case, when the temperature of the heat roller 1 is detected by a known temperature detector such as a thermister or the like and if the detected temperature is sufficiently high and the electric power supplied to the heat roller 1 can be reduced, the electric power discharged from the auxiliary electric power supply device 3 can be reduced by reducing the electric power supplied from the auxiliary electric power supply device 3 to the drive systems 300 and supplying electric power from the main electric power supply device 21, thereby reducing a charge time.

Although the electric power supplied from the auxiliary electric power supply device 3 is simply reduced in the example shown in FIG. 17, the electric power from the auxiliary electric power supply device 3 may be increased when it is required again. Additionally, the timing of reducing the electric power from the auxiliary electric power supply device 3 may be determined not in accordance with temperature information of the heat roller 1 but based on operation information of the image forming part such as a continuous printing time or a number of prints.

Although the device to which electric power is supplied form the auxiliary electric power supply device 3 is switched by the electric power distribution part 7 in the example shown in FIG. 10, the main electric power supply device 2 and the auxiliary electric power supplied device 3 may be connected to the electric power distribution part 7 so as to distribute the electric power of the both to the plurality of drive systems 300 appropriately. In such as case, if there is a remaining electric power in the auxiliary electric power supply device 3, the electric power from both the main electric power supply device 2 and the auxiliary electric power supply device 3 may be supplied to the drive systems 300 of the image forming apparatus, and when the remaining electric power runs out, the electric power from only the main power supply device 2 may be supplied to the hard disk drive 301 and the conveyance drive system 302.

Although the present invention is applied to the image forming apparatus, or the fixing device 1 or the fixing device 100 provided in the image forming apparatus in the above-mentioned embodiment, the present invention is applicable to a different apparatus of which energy source is electric power.

As described above, there are provided according to the present invention the following image forming apparatuses, in addition to the above-mentioned electric power supply control devices according to the present invention.

1) An image forming apparatus comprising:

an image forming part transferring a toner image onto a recording material; and a fixing device fixing the toner image onto the recording material so as to produce a printed matter, wherein the fixing device comprising:

a heating member heated by heat generated by a heat-generating member; and an opposing rotation member arranged opposite to the heating member so as to form a pressure-contact nip portion between the heating member and the opposing rotation member, wherein the recording material to which a toner image is transferred by the image forming part is introduced into the pressure-contact nip portion and is held and conveyed so as to fix the toner image on the recording material, the fixing device further comprising an electric power supply control device controlling electric power supplied to the heat-generating member to adjust a temperature of the heating member, wherein the electric power supply control device comprising:

an electric power supply part supplying electric power to the heat-generating member, which generates heat by electric power being supplied thereto, and to an electric power requiring part, which requires electric power to operate;

a control part controlling electric power supplied to the heat-generating member and the electric power requiring part; and a main electric power supply device and an auxiliary electric power supply device provided in the electric power supply part, wherein the control part includes:

a first electric power supply mode to supply electric power to the heat-generating member from only the main electric power supply device and supply electric power to the electric power requiring part from both the main electric power supply device and the auxiliary electric power requiring part; and a second electric power supply mode to supply electric power to the heat-generating member and the electric power requiring part from only the main electric power supply device and causing electric power supplied to the heat-generating member to be smaller than a rated electric power of the heat-generating member, wherein the electric power supplied to the heat-generating member in the first electric power supply mode is caused to be larger than the electric power supplied to the heat-generating member in the second electric power supply mode.

2) The image forming apparatus as recited in item 1), wherein the electric power requiring part is the image forming part.

3) An image forming apparatus comprising:

an image forming part transferring a toner image onto a recording material; and a fixing device fixing the toner image onto the recording material so as to produce a printed matter, wherein the fixing device comprising:

a belt-shaped fixing member;

a plurality of roller members on which the fixing member is wound;

a heating member heating the fixing member by heat generated by a heat-generating member; and an opposing rotation member forming a pressure-contact nip portion between the fixing member and one of the roller members, wherein the recording material to which a toner image is transferred by the image forming part is introduced into the pressure-contact nip portion and is held and conveyed so as to fix the toner image on the recording material, the fixing device further comprising an electric power supply control device controlling electric power supplied to the heat-generating member to adjust a temperature of the fixing member, wherein the electric power supply control device comprising:

an electric power supply part supplying electric power to the heat-generating member, which generates heat by electric power being supplied thereto, and to an electric power requiring part, which requires electric power to operate;

a control part controlling electric power supplied to the heat-generating member and the electric power requiring part; and a main electric power supply device and an auxiliary electric power supply device provided in the electric power supply part, wherein the control part includes:

a first electric power supply mode to supply electric power to the heat-generating member from only the main electric power supply device and supply electric power to the electric power requiring part from both the main electric power supply device and the auxiliary electric power requiring part; and a second electric power supply mode to supply electric power to the heat-generating member and the electric power requiring part from only the main electric power supply device and causing electric power supplied to the heat-generating member to be smaller than a rated electric power of the heat-generating member, wherein the electric power supplied to the heat-generating member in the first electric power supply mode is caused to be larger than the electric power supplied to the heat-generating member in the second electric power supply mode.

4) The image forming apparatus as recited in item 3), wherein the electric power requiring part is the image forming part.

5) An image forming apparatus comprising:

an image forming part transferring a toner image onto a recording material;

a fixing device heating the transferred toner image by a heating member heated by a heat-generating member; and an electric power supply part having a main power supply device, which supplies electric power to the image forming part and the heat-generating member and an auxiliary electric power supply device, wherein the recording material on which the toner image has been transferred is passed through the fixing device so as to fix the toner image onto the recording material to produce a printed material, the image forming apparatus further including:

a first electric power supply mode to supply electric power to the heat-generating member from only the main electric power supply device and supply electric power to the electric power requiring part from both the main electric power supply device and the auxiliary electric power requiring part; and a second electric power supply mode to supply electric power to the heat-generating member and the electric power requiring part from only the main electric power supply device and causing electric power supplied to the heat-generating member to be smaller than a rated electric power of the heat-generating member, wherein the electric power supplied to the heat-generating member in the first electric power supply mode is caused to be larger than the electric power supplied to the heat-generating member in the second electric power supply mode.

6) The image forming apparatus as recited in claim 5), wherein the control part causes the electric power supplied to the heat-generating member in the first electric power supply mode to be smaller than a maximum rated electric power of the heat-generating member.

7) The image forming apparatus as recited in item 5), further comprising an auxiliary electric power supply state detector detecting a state of the auxiliary electric power supply device, and wherein the control part selectively switches between the first electric power supply mode and the second electric power supply mode in accordance with detection information output from the auxiliary electric power supply state detector when the recording material is fed.

8) The image forming apparatus as recited in item 5), further comprising an auxiliary electric power supply state detector detecting a state of the auxiliary electric power supply device, and wherein the control part selectively switches between the first electric power supply mode and the second electric power supply mode in accordance with detection information output from the auxiliary electric power supply state detector when the image forming apparatus is turned on.

9) The image forming apparatus as recited in item 5), wherein the image forming part includes a plurality of electric power load devices, and the control part controls to supply electric power simultaneously to the plurality of electric power load devices when the first electric power supply mode is set.

10) The image forming apparatus as recited in item 5), wherein the image forming part includes a plurality of electric power load devices, and the control part supplies electric power to the plurality of electric power load devices through a constant voltage circuit.

11) The image forming apparatus as recited in item 5), further comprising a heat generation state detector detecting a state of the heat-generating member, and wherein the control part changes an amount of electric power supplied to the image forming part from the auxiliary power supply device in accordance with detection information output from the heat generation state detector.

12) The image forming apparatus as recited in item 5), wherein the state of the heat-generating member is a state of a temperature of the heating member, and the control part controls an amount of electric power supplied to the image forming part from the auxiliary electric power supply device to be reduced when the temperature of the heating member detected by the heat generation state detector is equal to or higher than a predetermined temperature.

13) The image forming apparatus as recited in item 5), further comprising an operation state detector detecting a state of operation of the image forming part, and wherein the control part changes an amount of electric power supplied to the image forming part from the auxiliary electric power supply device in accordance with detection information output from the operation state detector.

14) The image forming apparatus as recited in item 13), wherein the state of the image forming part indicates remaining electric power of the auxiliary electric power supply device, and the control part controls an amount of electric power supplied to the image forming part from the auxiliary electric power supply device in accordance with the remaining electric power detected by the operation state detector.

15) The image forming apparatus as recited in item 14), wherein the control part controls an amount of electric power supplied to the image forming part from the auxiliary electric power supply device to be suppressed and also controls a productivity of the printed matter to be reduced when the remaining electric power detected by the operation state detector is lower than a previously stored setting value.

16) The image forming apparatus as recited in item 5), further comprising a magnetic flux generating part heating the heating member by an alternating magnetic field generated by supplying electric power to the heat-generating member, wherein the control part controls electric power supplied to the heat-generating member so as to control the temperature of the heating member.

17) The image forming apparatus as recited in item 5), wherein the auxiliary power supply device includes a plurality of capacitors.

The present invention is not limited to the specifically disclosed embodiments, and variations and modifications may be made without departing form the scope of the present invention.

The present application is based on Japanese priority applications No. 2005-125790 filed Apr. 22, 2005 and No. 2005-210451 filed Jul. 20, 2005, the entire contents of which are hereby incorporated herein by reference.

What is claimed is:

1. An electric power supply control device comprising:

an electric power supply part supplying electric power to a heat-generating member, which generates heat by electric power being supplied thereto, and to an electric power requiring part, which requires electric power to operate;

a control part controlling electric power supplied to said heat-generating member and said electric power requiring part;

a main electric power supply device and an auxiliary electric power supply device provided in said electric power supply part; and an auxiliary electric power supply state detector detecting a state of said auxiliary electric power supply device, wherein said control part includes:

a first electric power supply mode to supply electric power to said heat-generating member from only said main electric power supply device and supply electric power to said electric power requiring part from both said main electric power supply device and said auxiliary electric power supply device; and a second electric power supply mode to supply electric power to said heat-generating member and said electric power requiring part from only said main electric power supply device and causing electric power supplied to said heat-generating member to be smaller than a rated electric power of said heat-generating member, wherein the electric power supplied to said heat-generating member in the first electric power supply mode is caused to be larger than the electric power supplied to said heat-generating member in the second electric power supply mode, and wherein said control part selectively switches between the first electric power supply mode and the second electric power supply mode in accordance with detection information output from said auxiliary electric power supply state detector when the electric power consumed by said heat-generating member is increasing, and wherein said control part controls said electric power requiring part to reduce an amount of printing by reducing an amount of electric power supplied to said electric power requiring part from said auxiliary electric power supply device when a remaining amount of electric power of said auxiliary electric power supply device detected by said auxiliary electric power supply state detector is smaller than a previously set setting value.

2. The electric power supply control device as claimed in claim 1, wherein said control part causes the electric power supplied to said heat-generating member in the first electric power supply mode to be smaller than a maximum rated electric power of said heat-generating member.

3. The electric power supply control device as claimed in claim 1, wherein said electric power requiring part includes a plurality of electric power load devices, and said control part supplies electric power simultaneously to said plurality of electric power load devices when the first electric power supply mode is set.

4. The electric power supply control device as claimed in claim 1, wherein said electric power requiring part includes a plurality of electric power load devices, and said control part supplies electric power to said plurality of electric power load devices through a constant voltage circuit heat generation control part.

5. The electric power supply control device as claimed in claim 1, further comprising a heat generation state detector detecting a state of said heat-generating member, and wherein said control part changes an amount of electric power supplied to said electric power requiring part from said auxiliary power supply device in accordance with detection information output from said heat generation state detector.

6. The electric power supply control device as claimed in claim 5, wherein the state of said heat-generating member is a state of a temperature of a heating member heated by said heat-generating member, and said control part controls an amount of electric power supplied to said electric power requiring part from said auxiliary electric power supply device to be reduced when the temperature of said heating member detected by said heat generation state detector is equal to or higher than a predetermined temperature.

7. The electric power supply control device as claimed in claim 1, further comprising an operation state detector detecting a state of operation of said electric power requiring part, and wherein said control part changes an amount of electric power supplied to said electric power requiring part from said auxiliary electric power supply device in accordance with detection information output from said operation state detector.

8. The electric power supply control device as claimed in claim 7, wherein the state of said electric power requiring part indicates remaining electric power of said auxiliary electric power supply device, and said control part controls an amount of electric power supplied to said electric power requiring part from said auxiliary electric power supply device in accordance with the remaining electric power detected by said operation state detector.

9. The electric power supply control device as claimed in claim 8, wherein said control part controls an amount of electric power supplied to said electric power requiring part from said auxiliary electric power supply device to be suppressed when the remaining electric power detected by said operation state detector is lower than a previously stored setting value.

10. The electric power supply control device as claimed in claim 1, wherein said auxiliary power supply device includes a plurality of capacitors.

11. A heating device comprising:

an electric power supply control device; and a heating member heated by a heat-generating member controlled by said electric power supply control device, wherein said electric power supply control device includes an electric power supply part supplying electric power to said heat-generating member, which generates heat by electric power being supplied thereto, and to an electric power requiring part, which requires electric power to operate;

a control part controlling electric power supplied to said heat-generating member and said electric power requiring part; and a main electric power supply device and an auxiliary electric power supply device provided in said electric power supply part, wherein said control part includes:

a first electric power supply mode to supply electric power to said heat-generating member from only said main electric power supply device and supply electric power to said electric power requiring part from both said main electric power supply device and said auxiliary electric power requiring part; and a second electric power supply mode to supply electric power to said heat-generating member and said electric power requiring part from only said main electric power supply device and causing electric power supplied to said heat-generating member to be smaller than a rated electric power of said heat-generating member, said electric power supply control device further comprising an auxiliary electric power supply state detector detecting a state of said auxiliary electric power supply device, wherein the electric power supplied to said heat-generating member in the first electric power supply mode is caused to be larger than the electric power supplied to said heat-generating member in the second electric power supply mode, wherein said control part selectively switches between the first electric power supply mode and the second electric power supply mode in accordance with detection information output from said auxiliary electric power supply state detector when the electric power consumed by said heat-generating member is increasing, and wherein said control part controls said electric power requiring part to reduce an amount of printing by reducing an amount of electric power supplied to said electric power requiring part from said auxiliary electric power supply device when a remaining amount of electric power of said auxiliary electric power supply device detected by said auxiliary electric power supply state detector is smaller than a previously set setting value.

12. A fixing device comprising:

a heating member heated by heat generated by a heat-generating member; and an opposing rotation member arranged opposite to said heating member so as to form a pressure-contact nip portion between the heating member and the opposing rotation member, wherein a recording material to which a toner image is transferred by an image forming part is introduced into said pressure-contact nip portion and is held and conveyed so as to fix said toner image on said recording material, said fixing device further comprising an electric power supply control device controlling electric power supplied to said heat-generating member to adjust a temperature of said heating member, wherein said electric power supply control device comprising:

an electric power supply part supplying electric power to said heat-generating member, which generates heat by electric power being supplied thereto, and to an electric power requiring part, which requires electric power to operate;

a control part controlling electric power supplied to said heat-generating member and said electric power requiring part; and a main electric power supply device and an auxiliary electric power supply device provided in said electric power supply part, wherein said control part includes:

a first electric power supply mode to supply electric power to said heat-generating member from only said main electric power supply device and supply electric power to said electric power requiring part from both said main electric power supply device and said auxiliary electric power requiring part; and a second electric power supply mode to supply electric power to said heat-generating member and said electric power requiring part from only said main electric power supply device and causing electric power supplied to said heat-generating member to be smaller than a rated electric power of said heat-generating member, wherein said fixing device further comprises:

an auxiliary electric power supply state detector detecting a state of said auxiliary electric power supply device, wherein the electric power supplied to said heat-generating member in the first electric power supply mode is caused to be larger than the electric power supplied to said heat-generating member in the second electric power supply mode, wherein said control part selectively switches between the first electric power supply mode and the second electric power supply mode in accordance with detection information output from said auxiliary electric power supply state detector when the electric power consumed by said heat-generating member is increasing, and wherein said control part controls said electric power requiring part to reduce an amount of printing by reducing an amount of electric power supplied to said electric power requiring part from said auxiliary electric power supply device when a remaining amount of electric power of said auxiliary electric power supply device detected by said auxiliary electric power supply state detector is smaller than a previously set setting value.

13. The fixing device as claimed in claim 12, further comprising a magnetic flux generating part heating said heating member by an alternating magnetic field generated by supplying electric power to said heat-generating member, wherein said control part control device controls electric power supplied to said heat-generating member so as to control the temperature of said heating member.

* * * * *